US010136222B2

(12) United States Patent
Hayashi et al.

(10) Patent No.: US 10,136,222 B2
(45) Date of Patent: Nov. 20, 2018

(54) SIGNAL PROCESSING APPARATUS AND SIGNAL PROCESSING METHOD TO REDUCE EXTERNAL NOISE

(71) Applicant: SONY CORPORATION, Tokyo (JP)

(72) Inventors: Shigetoshi Hayashi, Kanagawa (JP); Kohei Asada, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 19 days.

(21) Appl. No.: 15/317,961

(22) PCT Filed: May 15, 2015

(86) PCT No.: PCT/JP2015/064103

§ 371 (c)(1),
(2) Date: Dec. 11, 2016

(87) PCT Pub. No.: WO2016/002366

PCT Pub. Date: Jan. 7, 2016

(65) Prior Publication Data

US 2017/0142522 A1 May 18, 2017

(30) Foreign Application Priority Data

Jul. 1, 2014 (JP) ..... 2014-136103

(51) Int. Cl.
*H04R 1/10* (2006.01)
*H04R 5/04* (2006.01)
(Continued)

(52) U.S. Cl.
CPC ..... *H04R 5/04* (2013.01); *H04R 29/001* (2013.01); *H04R 2460/01* (2013.01); *H04R 2460/15* (2013.01)

(58) Field of Classification Search
CPC ..... G10K 2210/1081; G10K 11/178; G10K 2210/3033; G10K 2210/108;
(Continued)

(56) References Cited

U.S. PATENT DOCUMENTS

2008/0112569 A1* 5/2008 Asada ..... G10K 11/178 381/71.1
2008/0112570 A1* 5/2008 Asada ..... G10K 11/1782 381/71.6
(Continued)

FOREIGN PATENT DOCUMENTS

CN 101184345 A 5/2008
EP 1923864 A2 5/2008
(Continued)

OTHER PUBLICATIONS

International Search Report and Written Opinion of PCT Application No. PCT/JP2015/064103, dated Aug. 4, 2015, 5 pages of English Translation and 5 pages of ISRWO.
(Continued)

*Primary Examiner* — Norman Yu
(74) *Attorney, Agent, or Firm* — Chip Law Group

(57) ABSTRACT

[Object] To provide a signal processing apparatus which can allow a user to listen to sound assumed by a designer while a difference among individuals is taken into account. [Solution] Provided is a signal processing apparatus including: a characteristics difference calculating unit configured to calculate a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and a sound signal processing unit configured to select a parameter to be used at the signal processing based on the difference calculated by the characteristics difference calculating unit, and perform signal processing on the first sound signal.

14 Claims, 18 Drawing Sheets

(51) Int. Cl.
*H04R 29/00* (2006.01)
*G10K 11/16* (2006.01)

(58) Field of Classification Search
CPC ..... G10K 2210/3013; G10K 11/1784; G10K 2210/30231; G10K 2210/3035; G10K 2210/30391; G10K 2210/3055; G10K 2210/504; H04R 1/1083; H04R 2460/01; H04R 2460/03; H04R 5/033; H04R 3/00; H04R 3/002; H04R 3/005; H04R 3/04
USPC ..... 381/71.6, 74, 71.1, 71.11, 370
See application file for complete search history.

(56) References Cited

U.S. PATENT DOCUMENTS

2008/0137873 A1* 6/2008 Goldstein ..... H04R 1/1016 381/57
2010/0166206 A1* 7/2010 Macours ..... G10K 11/178 381/71.6
2011/0170700 A1 7/2011 Miseki et al.
2014/0105412 A1* 4/2014 Alves ..... G10K 11/1784 381/71.6
2014/0146976 A1* 5/2014 Rundle ..... H04R 1/1083 381/71.6

FOREIGN PATENT DOCUMENTS

JP 2008-122729 A 5/2008
JP 4709927 B1 6/2011
JP 2011-146875 A 7/2011

OTHER PUBLICATIONS

International Preliminary Report on Patentability of PCT Application No. PCT/JP2015/064103, dated Jan. 3, 2017, pp. 4.
Office Action for CN Patent Application No. 201580033670.6, dated Aug. 24, 2018, 04 pages of Office Action and 08 pages of English Translation.

* cited by examiner

SIGNAL PROCESSING APPARATUS AND SIGNAL PROCESSING METHOD TO REDUCE EXTERNAL NOISE

CROSS REFERENCE TO RELATED APPLICATIONS

This application is a U.S. National Phase of International Patent Application No. PCT/JP2015/064103 filed on May 15, 2015, which claims priority benefit of Japanese Patent Application No. JP 2014-136103 filed in the Japan Patent Office on Jul. 1, 2014. Each of the above-referenced applications is hereby incorporated herein by reference in its entirety.

TECHNICAL FIELD

The present disclosure relates to a signal processing apparatus, a signal processing method, and a computer program.

BACKGROUND ART

In accordance with spread of a portable audio player, a noise reduction system has begun to spread, which is designed for a headphone or an earphone for the portable audio player and which reduces noise of an external environment to provide favorable reproduction sound field space in which external noise is reduced, to a listener.

For example, Patent Literature 1 discloses a noise reduction apparatus which converts an analog signal of external noise obtained by being collected at a microphone into a digital signal, generates a noise reduced signal for reducing the external noise using the digital signal and applies the noise reduced signal to an audio signal.

CITATION LIST

Patent Literature

Patent Literature 1: JP 2008-122729A

SUMMARY OF INVENTION

Technical Problem

However, a volume or air density inside a headphone can be varied according to physical characteristics of a listener such as a shape of the head and a size of the ear, and external factors such as whether or not a listener uses glasses. Therefore, characteristics of an audio signal at a time point at which sound by the audio signal after a noise reduced signal is applied reaches the ears of the listener can change according to listeners, because a volume or air density inside the headphone can change according to listeners. Further, the characteristics of the audio signal at a time point at which the audio signal after the noise reduced signal is applied reaches the ears of the listener can change according to a difference in how the earphone or the headphone is worn. Therefore, there is a need for providing a noise reduction effect assumed by a designer while a difference among individuals is taken into account.

Therefore, the present disclosure proposes a new and improved signal processing apparatus, signal processing method and computer program which can allow a user to listen to sound assumed by a designer while a difference among individuals is taken into account.

Solution to Problem

According to the present disclosure, there is provided a signal processing apparatus including: a characteristics difference calculating unit configured to calculate a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and a sound signal processing unit configured to select a parameter to be used at the signal processing based on the difference calculated by the characteristics difference calculating unit, and perform signal processing on the first sound signal.

According to the present disclosure, there is provided a signal processing method including: calculating a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and selecting a parameter to be used for the signal processing based on the calculated difference.

According to the present disclosure, there is provided a computer program causing a computer to execute: calculation of a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and selection of a parameter to be used for the signal processing based on the calculated difference.

Advantageous Effects of Invention

As described above, according to the present disclosure, it is possible to provide a new and improved signal processing apparatus, signal processing method and computer program which can allow a user to listen to sound assumed by a designer while a difference among individuals is taken into account.

Note that the effects described above are not necessarily limitative. With or in the place of the above effects, there may be achieved any one of the effects described in this specification or other effects that may be grasped from this specification.

DESCRIPTION OF EMBODIMENT

Figure 1:
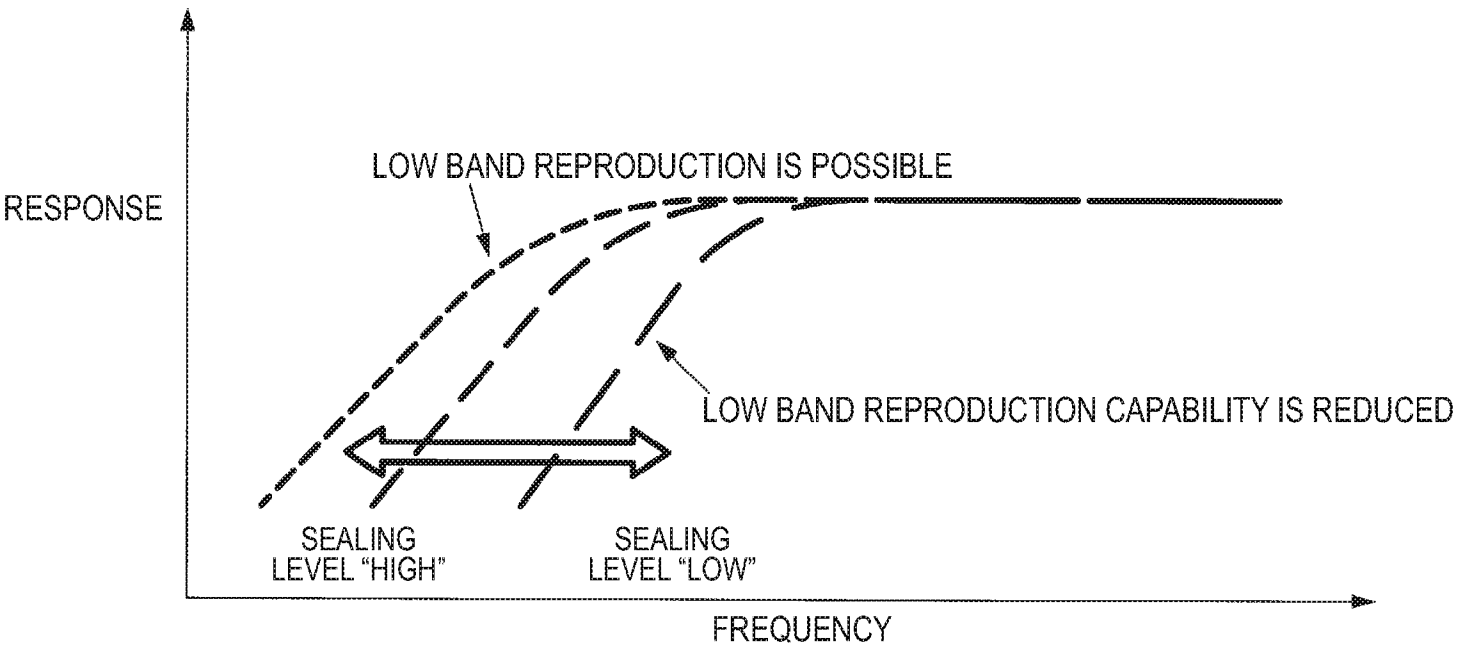
FIG. 1 is an explanatory diagram illustrating change of response according to a difference in how a headphone is worn using a graph.

Hereinafter, a preferred embodiment of the present disclosure will be described in detail with reference to the appended drawings. In this specification and the appended drawings, structural elements that have substantially the same function and structure are denoted with the same reference numerals, and repeated explanation of these structural elements is omitted.

Note that description will be provided in the following order.

1. Embodiment of the present disclosure
1.1. Outline
1.2. Functional configuration example
1.3. Operation example
1.4. Application example
2. Conclusion

1. Embodiment of the Present Disclosure

1.1. Outline

Before an embodiment of the present disclosure is described, first, outline of an embodiment of the present disclosure will be described.

In recent years, a portable music player has been spread, and it can be considered that there are many listeners whose main music listening environment is outside the house, and who listen to music by utilizing headphones. However, there can be a case where some listeners cannot listen to music with sound quality intended by a designer, or a case where a noise reduction effect which should have been essentially provided at a headphone provided with a noise canceling function cannot be provided.

This is because typically commercially available headphones are mass-produced goods, and, expect only a few exceptions such as a special order product manufactured by part of makers by measuring the ears of the listener, a volume or air density inside the headphone can be varied according to physical characteristics of the listener such as the shape of the head and the size of the ear, and external factors such as whether or not the listener wears glasses as described above. Therefore, characteristics of an audio signal after a noise reduced signal is applied can change according to listeners. Further, characteristics of the audio signal after the noise reduced signal is applied can also change according to a difference in how the earphone or the headphone is worn.

Further, there can be a case where response in a low band of a music signal or a sound signal (hereinafter, they will be collectively simply referred to as an "audio signal") changes according to the above-described physical characteristics and external factors, and the listener cannot listen to sound with sound quality intended by a designer.

FIG. 1 is an explanatory diagram illustrating change of response according to a difference in how the headphone is worn using a graph. FIG. 1 indicates the difference in how the headphone is worn using an index of a "sealing level" which indicates how little space is left between the head of the listener and a housing of the headphone. That is, when the headphone is worn on the ears of the listener, if there is less space between the head of the listener and the housing of the headphone, the sealing level is higher, while, if there is more space between the head of the listener and the housing of the headphone, the sealing level is lower. The graph illustrated in FIG. 1 indicates a frequency on a horizontal axis, and indicates a degree of response when sound of the frequency is reproduced on a vertical axis. As illustrated in FIG. 1, if the sealing level is higher, the response in a low frequency domain becomes higher, so that low band reproduction is possible. However, if the sealing level becomes lower, the response in the low frequency domain becomes lower, so that low band reproduction capability is reduced.

Figure 2:
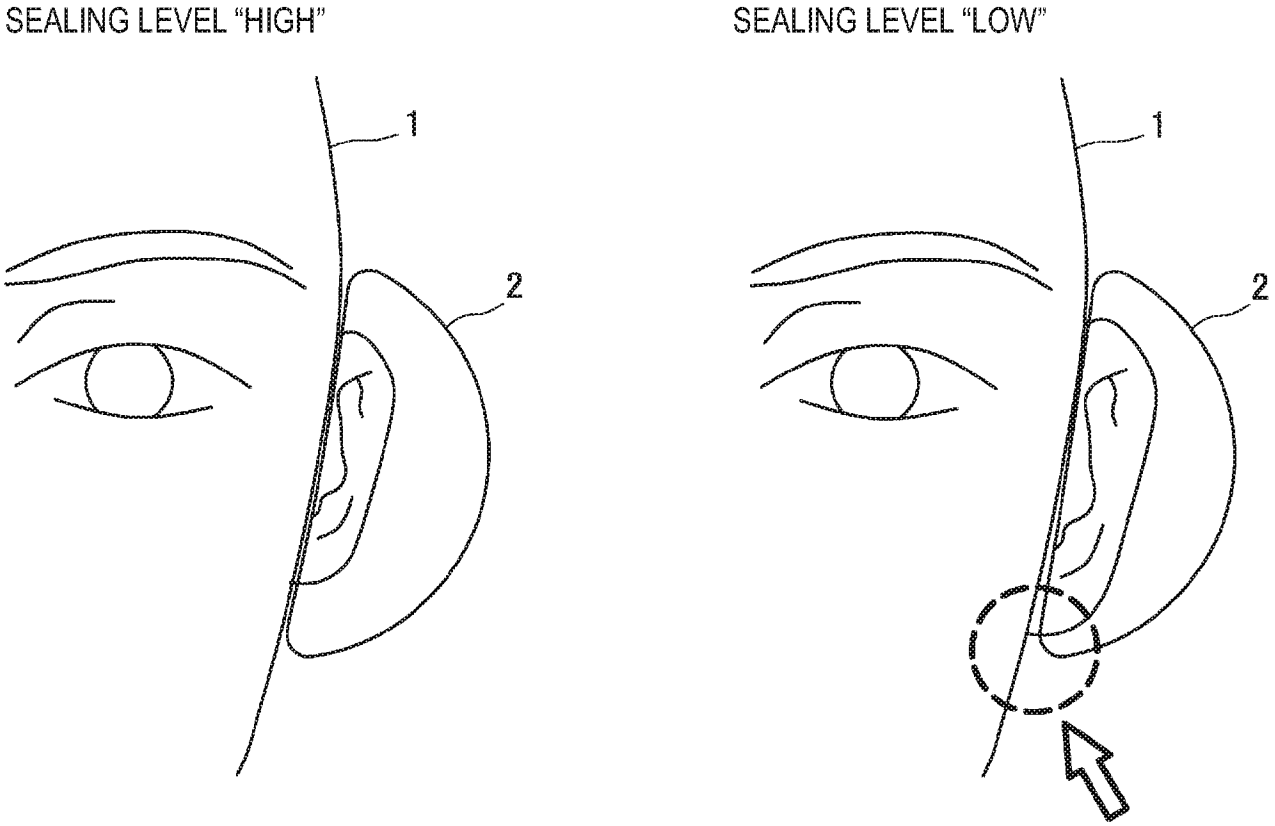
FIG. 2 is an explanatory diagram schematically illustrating a difference in a sealing level.

There are various factors in change of the sealing level as described above. FIG. 2 is an explanatory diagram schematically illustrating a difference in the sealing level. FIG. 2 illustrates two states where a listener 1 wears a housing 10 of a so-called overhead type headphone. The sealing level can change as illustrated in FIG. 2 due to an error in wearing of the headphone by the listener 1, according to a difference among individuals resulting from physical characteristics (such as the size of ears and the length of hair) of the listener 1 or according to external factors such as whether or not the listener 1 wears glasses. Further, a volume of air inside the housing 10 changes according to the size of the ears, and a difference in the volume of air and characteristics of sound output from the headphone can also change.

While the above-described example is an example in the case of a so-called overhead type headphone which is used by being hanged on the head, the same phenomenon can be seen in the case of a so-called inner ear type headphone which is used by being inserted into the porus acusticus. While ear pieces are loaded in advance in the inner ear type headphone, when the listener uses the inner ear type headphone, because the listener tends to continue to use the ear pieces at the time of purchase, there is a possibility that the listener uses the headphone although there is large space with the ears, or that the listener uses the headphone in a state where the ear pieces are off from the ears, so that a difference in the sealing level among individuals can be more noticeable.

Further, noise tends to concentrate on a low band, and, in the case of a headphone having a digital noise canceling function, a sufficient cancellation signal cannot be output in a state where response in the low band is low, and there is a possibility that noise cannot be sufficiently reduced. Therefore, when the listener wears the headphone in a state where the sealing level is low, there is a possibility that a noise reduction effect which should have been essentially provided cannot be provided.

Therefore, the present disclosers studied hard a technology for making sound to be reproduced closer to characteristics intended by the designer and maximizing a noise reduction effect regardless of how the listener wears the headphone. The present disclosers then achieved a technology for making sound to be reproduced closer to characteristics intended by the designer and maximizing the noise reduction effect by comparing expected characteristics of sound to be reproduced at the headphone with characteristics of sound actually output from a driver of the headphone as will be described below.

The outline of one embodiment of the present disclosure has been described above. Subsequently, a functional configuration example of one embodiment of the present disclosure will be described.

1.2. Functional Configuration Example

Figure 3:
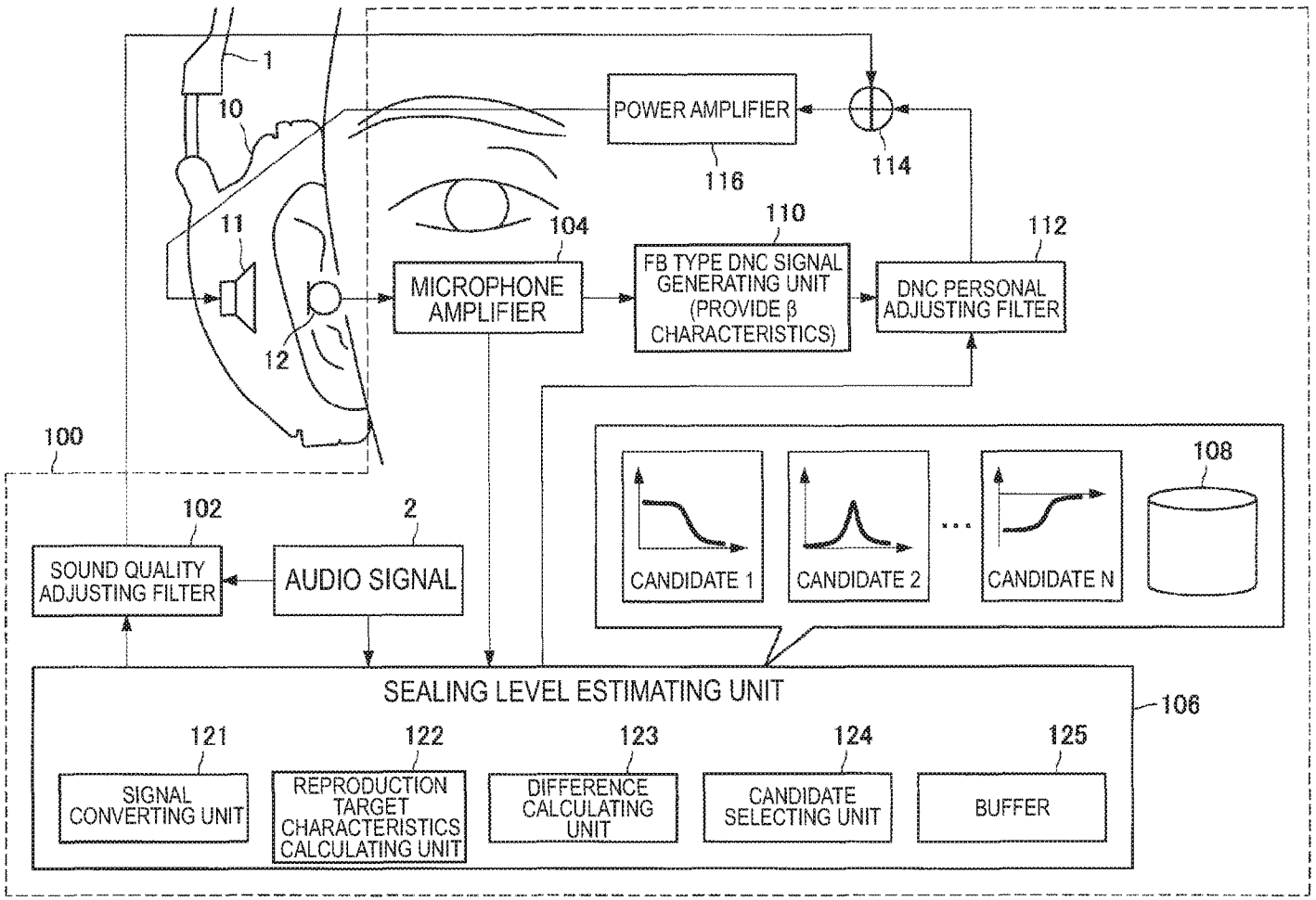
FIG. 3 is an explanatory diagram illustrating a functional configuration example of a signal processing apparatus 100 according to an embodiment of the present disclosure.

FIG. 3 is an explanatory diagram illustrating a functional configuration example of a signal processing apparatus 100 according to one embodiment of the present disclosure. The signal processing apparatus 100 illustrated in FIG. 3 is an apparatus which performs noise reduction processing of reducing noise generated from a noise source (not illustrated) as signal processing. The functional configuration example of the signal processing apparatus 100 according to one embodiment of the present disclosure will be described below using FIG. 3.

The signal processing apparatus 100 illustrated in FIG. 3 collects sound output from a driver 11 provided at the hosing 10 of the headphone worn by the listener 1 at a microphone 12 and compares characteristics of sound collected at the microphone 12 with characteristics of an audio signal 2 to be supplied to the headphone. The signal processing apparatus 100 illustrated in FIG. 3 then compares the characteristics of the sound collected at the microphone 12 with the characteristics of the audio signal 2 to be supplied to the headphone to execute signal processing on the audio signal 2 to be supplied to the headphone.

As illustrated in FIG. 3, the signal processing apparatus 100 according to one embodiment of the present disclosure includes a sound quality adjusting filter 102, a microphone amplifier 104, a sealing level estimating unit 106, a correction filter database 108, a digital noise cancelling (DNC) signal generating unit 110, a DNC personal adjusting filter 112, an adder 114, and a power amplifier 116. The signal processing apparatus 100 according to one embodiment of the present disclosure is connected with the headphone using a predetermined connection cable. Note that, in FIG. 3, because an analog/digital converter for converting an analog sound signal collected at the microphone 12 into a digital signal, and a digital/analog converter for converting a digital signal into an analog signal to be supplied to the driver 11 are obvious, the analog/digital converter and the digital/analog converter are not illustrated.

The sound quality adjusting filter 102 is a filter which performs filtering on the audio signal 2 to be supplied to the headphone to adjust sound quality of the audio signal 2. The sound quality adjusting filter 102 is a filter for outputting sound as intended by a designer of the headphone from the driver 11. The sound as intended by the designer of the headphone is sound which can be listened to by the listener 1 when the physical shape of the listener is the one intended by the designer and when the listener 1 wears the headphone correctly.

In the present embodiment, the sound quality adjusting filter 102 has a plurality of filters. The sound quality adjusting filter 102 performs filtering on the audio signal 2 to be supplied to the headphone using a candidate for the filter selected by the sealing level estimating unit 106 which will be described later. The sound quality adjusting filter 102 outputs the filtered audio signal 2 to the adder 114.

The microphone amplifier 104 is an amplifier which amplifies an analog signal (audio reproduction signal) obtained by being collected at the microphone 12 by a predetermined amount to generate a noise canceling signal. The microphone amplifier 104 amplifies the audio reproduction signal obtained by being collected at the microphone 12 by a predetermined amount, and then, outputs the amplified audio reproduction signal to the sealing level estimating unit 106 and the DNC signal generating unit 110.

The sealing level estimating unit 106 estimates a sealing level of the housing 10 of the headphone by comparing the characteristics of the audio signal 2 to be supplied to the headphone with the characteristics of the audio reproduction signal output from the microphone amplifier 104. Here, the sealing level in the present embodiment refers to variation in how the housing 10 is worn by the listener 1 of the headphone or a degree of the sealing level of the housing 10 resulting from the physical characteristics of the listener 1. The sealing level estimating unit 106 can be configured as, for example, a digital signal processor (DSP) or a central processing unit (CPU).

As illustrated in FIG. 3, the sealing level estimating unit 106 includes a signal converting unit 121, a reproduction target characteristics calculating unit 122, a difference calculating unit 123, a candidate selecting unit 124 and a buffer 125.

The signal converting unit 121 executes signal processing of converting a signal from a time domain into a frequency domain on the audio signal 2 to be supplied to the headphone and the audio reproduction signal output from the microphone amplifier 104. The signal converting unit 121 executes, for example, fast Fourier transform (FFT) as the signal processing to be performed on the audio signal 2 to be supplied to the headphone and the audio reproduction signal output from the microphone amplifier 104. The signal converting unit 121 performs fast Fourier transform on the audio signal 2 to be supplied to the headphone and the audio reproduction signal output from the microphone amplifier 104 to convert the two signals from a time domain into a frequency domain. The signals converted by the signal converting unit 121 may be temporarily buffered in the buffer 125.

The reproduction target characteristics calculating unit 122 performs calculation on the audio signal 2 converted into a frequency domain by the signal converting unit 121 to perform conversion so that amplitude characteristics of the sound become characteristics as intended by the designer of the headphone. Frequency characteristics after calculation is performed on the audio signal 2 are also referred to as reproduction target characteristics. In the present embodiment, the reproduction target characteristics calculating unit 122 converts the amplitude characteristics of the audio signal 2 into the reproduction target characteristics by multiplying the audio signal 2 converted into the frequency domain by the signal converting unit 121 by a reproduction target transfer function. Note that the reproduction target transfer function is a function defined as a system configured with characteristics of the driver 11 of the headphone, spatial characteristics inside the housing 10 and characteristics of the microphone 12. The reproduction target characteristics generated through conversion by the reproduction target characteristics calculating unit 122 may be temporarily buffered in the buffer 125.

The difference calculating unit 123 which is one example of the characteristics difference calculating unit of the present disclosure, calculates a difference between the reproduction target characteristics converted by the reproduction target characteristics calculating unit 122 and the frequency characteristics of the audio reproduction signal output from the microphone amplifier 104 for each frequency. Data of the difference calculated by the difference calculating unit 123 is used to select a candidate for the filter at the candidate selecting unit 124. Note that the data of the difference calculated at the difference calculating unit 123 may be temporarily buffered in the buffer 125. Further, the difference calculated at the difference calculating unit 123 can include a difference on a logarithmic axis, a difference on a linear axis, or the like.

The candidate selecting unit 124 selects a candidate for the filter to be used at the sound quality adjusting filter 102 and the DNC personal adjusting filter 112 from the difference between the reproduction target characteristics converted by the reproduction target characteristics calculating unit 122 and the frequency characteristics of the audio reproduction signal converted by the signal converting unit 121 and output from the microphone amplifier 104, calculated by the difference calculating unit 123. More specifically, the candidate selecting unit 124 selects a parameter of the filter to be used at the sound quality adjusting filter 102 and the DNC personal adjusting filter 112 based on the difference. In the present embodiment, the filter selected by the candidate selecting unit 124 is also referred to as a "personalized filter". The candidate selecting unit 124 may use the data of the difference buffered in the buffer 125 when selecting the candidate for the filter.

As described above, response can change according to the sealing level. Particularly, response in a low frequency domain can change according to the sealing level. The signal processing apparatus 100 according to the present embodiment can recognize how much degree the characteristics of the sound to be listened to by the listener 1 is different from the reproduction target characteristics by calculating at the difference calculating unit 123 the difference between the reproduction target characteristics converted by the reproduction target characteristics calculating unit 122 and the frequency characteristics of the audio reproduction signal converted by the signal converting unit 121 and output from the microphone amplifier 104. The signal processing apparatus 100 according to the present embodiment selects a candidate for the personalized filter to be used at the sound quality adjusting filter 102 and the DNC personal adjusting filter 112 based on the difference from the reproduction target characteristics. That is, the candidate selecting unit 124 selects one parameter of the filter to be used at the sound quality adjusting filter 102 and the DNC personal adjusting filter 112 among the parameters set in advance based on the difference.

The signal processing apparatus 100 according to the present embodiment can allow the listener 1 to listen to the sound by the audio signal 2 with sound quality intended by the designer of the headphone regardless of the difference in how the listener 1 wears the headphone or the sealing level resulting from the physical characteristics of the listener 1 by selecting the candidate for the personalized filter to be used at the sound quality adjusting filter 102 and the DNC personal adjusting filter 112 based on the difference from the reproduction target characteristics.

The buffer 125 is a storage region for temporarily buffering a calculation result at the signal converting unit 121, the reproduction target characteristics calculating unit 122 or the difference calculating unit 123. Note that the buffer 125 only has to be provided inside the signal processing apparatus 100 and does not necessarily have to be provided inside the sealing level estimating unit 106.

The DNC signal generating unit 110 generates a noise canceling signal for reducing noise generated by a noise source (not illustrated) when the sound by the audio signal 2 is listened to by the listener 1. FIG. 3 illustrates a feedback (FB) type noise canceling system which collects sound including a noise component going into the headphone, analyzing the noise component and generating a noise canceling signal for canceling out the noise component. The DNC signal generating unit 110 provides predetermined signal characteristics (β characteristics) compatible with the FB type noise canceling system. The β characteristics provided by the DNC signal generating unit 110 are set so that the sound is listened to by the listener 1 while external noise is reduced by transfer functions (including a spatial transfer function from the driver 11 to the microphone 12) of the units configuring a feedback loop illustrated in FIG. 3 being taken into account in advance. In other words, by the β characteristics being provided within the above-described feedback loop, when the sound output through the driver 11 and the external noise from the noise source are spatially mixed inside the housing 10, the sound is perceived by the listener 1 while the above-described external noise is reduced.

The DNC signal generating unit 110 can apply a technology disclosed in, for example, JP 2008-116782A, JP 2008-124792A, or the like, as a method for calculating β characteristics compatible with the FB type noise canceling system. The method for calculating β characteristics compatible with the FB type noise canceling system will be simply described below. The DNC signal generating unit 110 converts the analog signal output from the microphone amplifier 104 into a digital signal and generates a noise reduced signal from the digital signal. The DNC signal generating unit 110 outputs the noise reduced signal to the DNC personal adjusting filter 112. The DNC signal generating unit 110 can be configured as, for example, a DSP or a CPU. The noise reduced signal is converted into an analog signal and reproduced at the power amplifier after the corrected audio signal is added at the adder 114. Alternatively, this power amplifier may be expressed as a digital amplifier.

The DNC personal adjusting filter 112 performs filtering on the noise reduced signal output from the DNC signal generating unit 110. In the present embodiment, the DNC personal adjusting filter 112 has a plurality of filters (personalized filters). The DNC personal adjusting filter 112 performs filtering on the noise reduced signal output from the DNC signal generating unit 110 using a candidate for the personalized filter selected by the above-described sealing level estimating unit 106.

The adder 114 adds the audio signal 2 output from the sound quality adjusting filter 102 and the noise reduced signal output from the DNC personal adjusting filter 112. The adder 114 adds the audio signal 2 output from the sound quality adjusting filter 102 and the noise reduced signal output from the DNC personal adjusting filter 112 and outputs the signal obtained through addition to the power amplifier 116.

The power amplifier 116 amplifies a signal to be output from the adder 114 by a predetermined amount. The power amplifier 116 amplifies the signal to be output from the adder 114 by a predetermined amount and outputs the amplified signal to the driver 11.

Because the signal processing apparatus 100 according to one embodiment of the present disclosure has the above-described configuration, the signal processing apparatus 100 can select a candidate for the personalized filter to be used at the sound quality adjusting filter 102 and the DNC personal adjusting filter 112 based on the difference from the reproduction target characteristics. The signal processing apparatus 100 according to one embodiment of the present disclosure can allow the listener 1 to listen to the sound by the audio signal 2 with sound quality intended by the designer of the headphone regardless of the difference in how the listener 1 wears the headphone or the sealing level resulting from the physical characteristics of the listener 1 by selecting a candidate for the personalized filter to be used at the sound quality adjusting filter 102 and the DNC personal adjusting filter 112.

The functional configuration example of the signal processing apparatus 100 according to one embodiment of the present disclosure has been described above using FIG. 3. Subsequently, an operation example of the signal processing apparatus 100 according to one embodiment of the present disclosure will be described.

1.3. Operation Example

Figure 4:
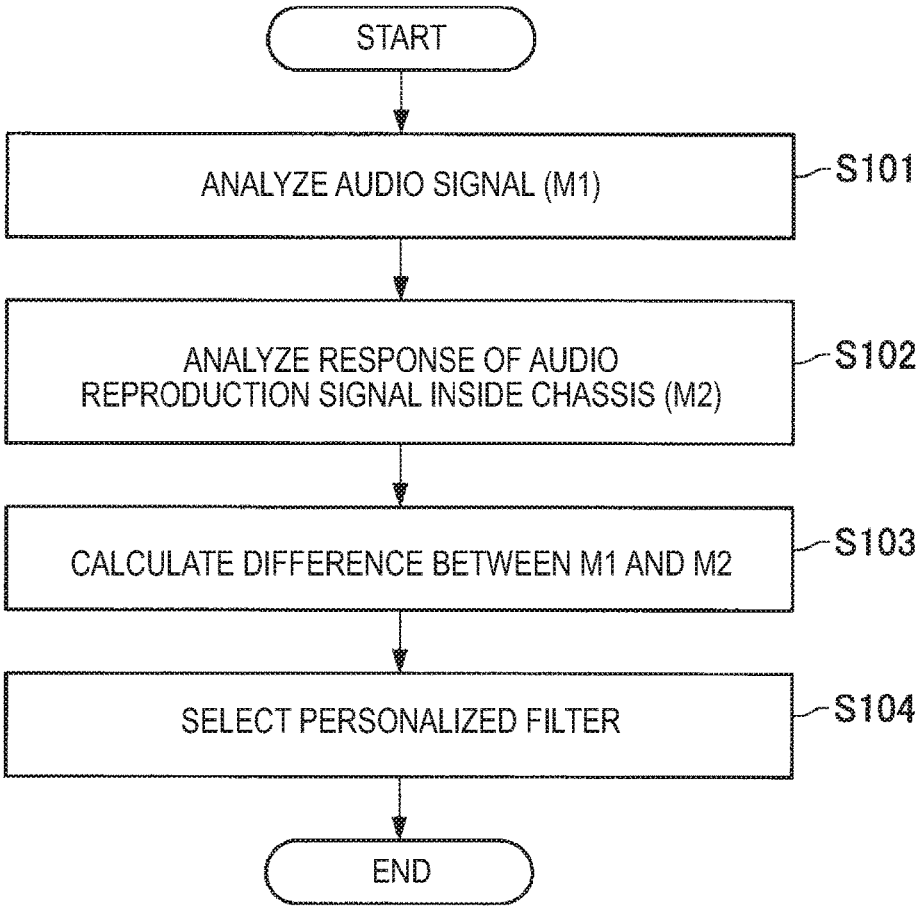
FIG. 4 is a flowchart illustrating an operation example of the signal processing apparatus 100 according to an embodiment of the present disclosure.

FIG. 4 is a flowchart illustrating the operation example of the signal processing apparatus 100 according to one embodiment of the present disclosure. FIG. 4 illustrates an operation example of the signal processing apparatus 100 when the personalized filter is selected by comparing the audio signal 2 with the audio reproduction signal obtained by being collected at the microphone 12. The operation example of the signal processing apparatus 100 according to one embodiment of the present disclosure will be described below using FIG. 4.

First, the signal processing apparatus 100 analyzes the audio signal 2 (step S101). The analysis of the audio signal 2 can be executed by, for example, the sealing level estimating unit 106. While the analysis processing of the audios signal 2 in step S101 will be described in detail later, in the present embodiment, the signal processing apparatus 100 executes FFT or performs multiplication by the reproduction target transfer function as the analysis processing of the audio signal 2. The analysis result of the audio signal 2 is set as M1.

Further, the signal processing apparatus 100 analyzes response of the audio reproduction signal output from the microphone amplifier 104 (step S102). The analysis of the response of the audio reproduction signal can be executed by, for example, the sealing level estimating unit 106. While the analysis processing of the response of the audio reproduction signal in step S102 will be described in detail later, in the present embodiment, the signal processing apparatus 100 executes FFT as the analysis processing of the response of the audio reproduction signal. The analysis result of the response of the audio reproduction signal is set as M2.

Subsequently, the signal processing apparatus 100 calculates a difference between the analysis result M1 of the audio signal 2 and the analysis result M2 of the response of the audio reproduction signal (step S103). The analysis of the response of the audio reproduction signal can be executed by, for example, the sealing level estimating unit 106.

Figure 5:
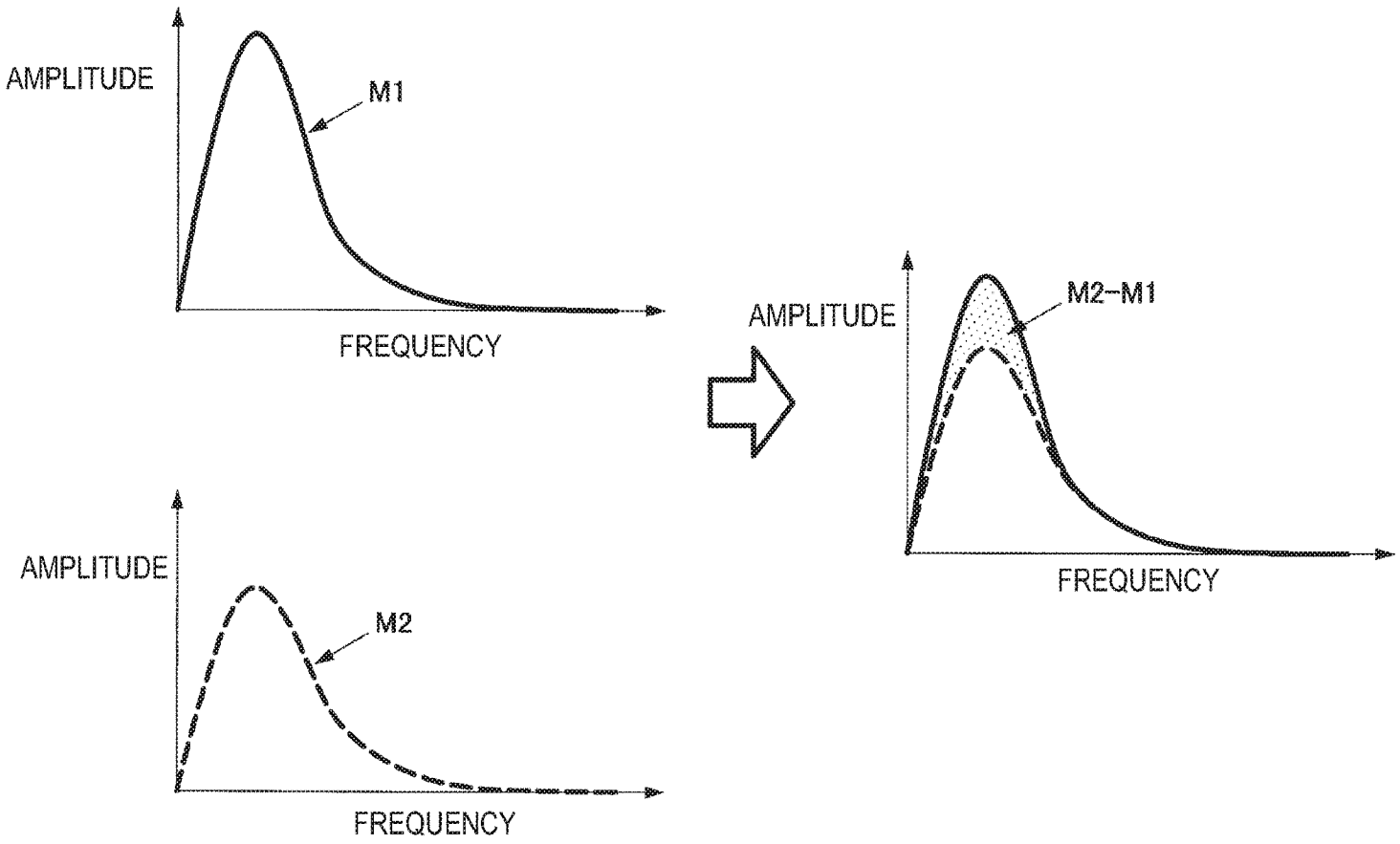
FIG. 5 is an explanatory diagram illustrating aspect where a difference between an analysis result of an audio signal and an analysis result of response of an audio reproduction signal is calculated.

FIG. 5 is an explanatory diagram illustrating aspect where the difference between the analysis result M1 of the audio signal 2 and the analysis result M2 of the audio reproduction signal is calculated using graphs. The graphs illustrated in FIG. 5 indicate a frequency on a horizontal axis and indicate amplitude on a vertical axis. The analysis result M1 of the audio signal 2 corresponds to reproduction target characteristics. It can be understood from calculation of the difference that, in the example illustrated in FIG. 5, the amplitude of the analysis result M1 of the audio signal 2 is greater than the amplitude of the analysis result M2 of the response of the audio reproduction signal mainly in a low frequency domain.

The signal processing apparatus 100 calculates the difference between the analysis result M1 of the audio signal 2 and the analysis result M2 of the response of the audio reproduction signal in the above-described step S103, and, then, selects a personalized filter based on the difference (step S104). The selection of the personalized filter is executed by, for example, the sound quality adjusting filter 102 and the DNC personal adjusting filter 112.

Figure 6:
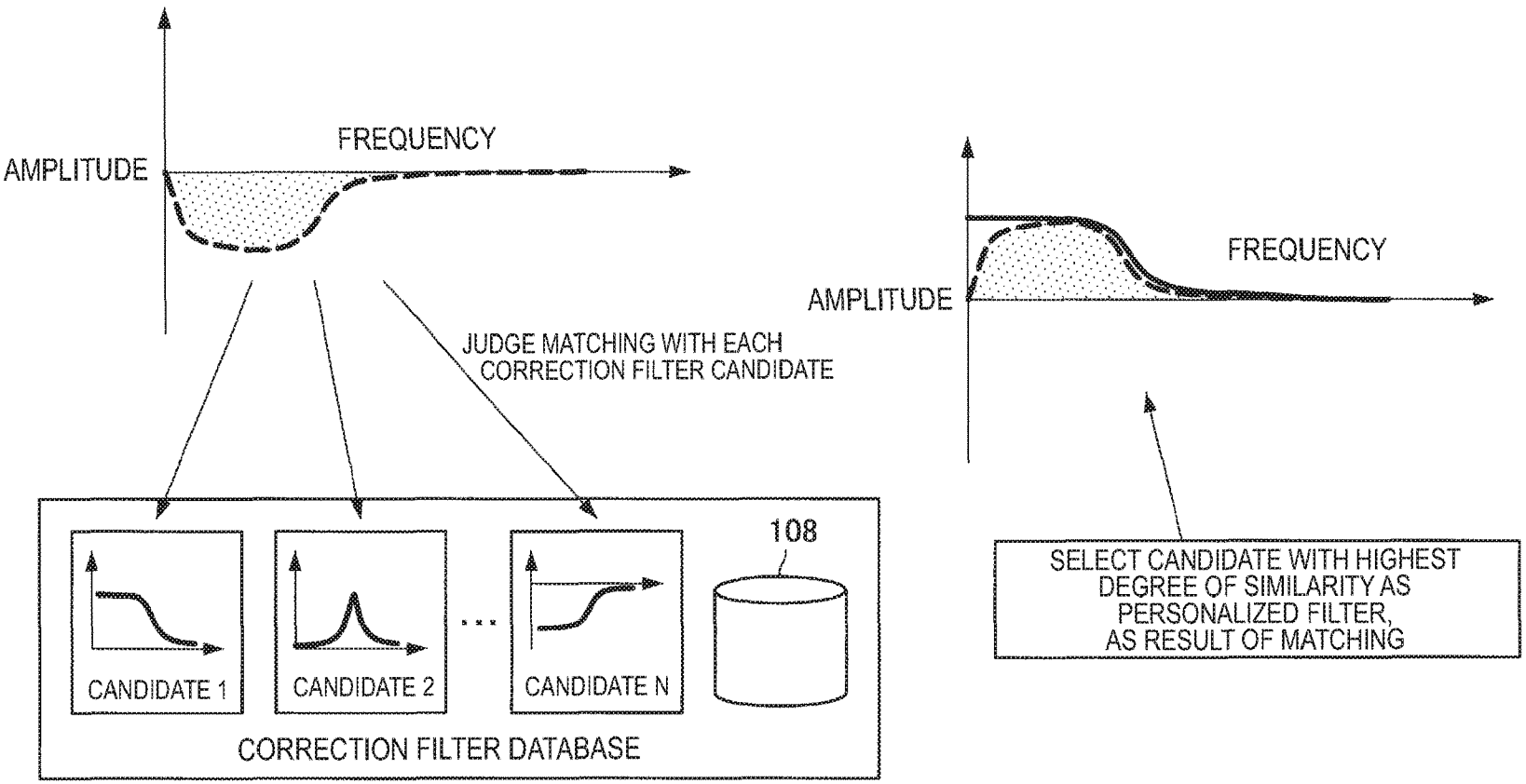
FIG. 6 is an explanatory diagram illustrating an example of selection of a personalized filter.

FIG. 6 is an explanatory diagram illustrating an example of selection of the personalized filter. For example, when the analysis result M1 of the audio signal 2 and the analysis result M2 of the response of the audio reproduction signal are those as illustrated in FIG. 5, the amplitude of the analysis result M1 of the audio signal 2 is greater than the amplitude of the analysis result M2 of the response of the audio reproduction signal mainly in a low frequency domain. Therefore, in this case, the signal processing apparatus 100 only has to select the personalized filter which amplifies the low frequency domain for the audio reproduction signal in step S104.

In the present embodiment, a finite number of candidates for the personalized filter are stored in the correction filter database 108. The candidates for the personalized filter stored in the correction filter database 108 are all selected as a result of test performed in advance so that output is not diverged when the filter is applied.

The difference calculated in step S103 does not necessarily completely match the candidates for the personalized filter stored in the correction filter database 108. Therefore, the signal processing apparatus 100 judges matching between the difference calculated in step S103 and each filter candidate when selecting the personalized filter in the above-described step S104, and selects a candidate with the highest degree of similarity as the personalized filter, as a result of the matching.

Figure 7:
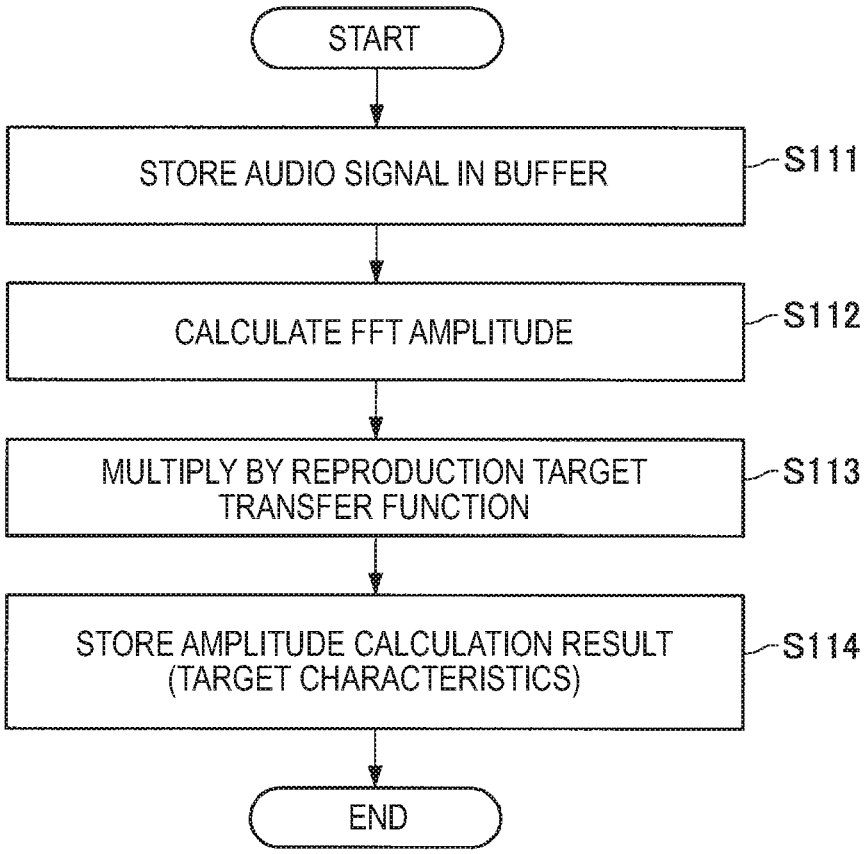
FIG. 7 is a flowchart illustrating an operation example of the signal processing apparatus 100 according to an embodiment of the present disclosure.

Subsequently, the processing in the above-described step S101 will be described in detail. FIG. 7 is a flowchart illustrating the operation example of the signal processing apparatus 100 according to one embodiment of the present disclosure. FIG. 7 illustrates a flowchart which explains the analysis processing of the audio signal 2 in the above-described step S101 in detail.

The signal processing apparatus 100 first buffers the audios signal 2 in the buffer 125 when analyzing the audio signal 2 (step S111). The audio signal 2 is buffered in step S111 by, for example, the signal converting unit 121 buffering the audio signal 2 in the buffer 125.

Subsequently, the signal processing apparatus 100 executes FFT on the buffered audio signal 2 and calculates amplitude for each frequency of the audio signal 2 (step S112). The calculation of the amplitude in step S112 can be executed by, for example, the signal converting unit 121.

Subsequently, the signal processing apparatus 100 multiplies the audio signal 2 after FFT is executed by the reproduction target transfer function to calculate reproduction target characteristics (step S113). The multiplication in step S113 can be executed by, for example, the reproduction target characteristics calculating unit 122.

Figure 8:
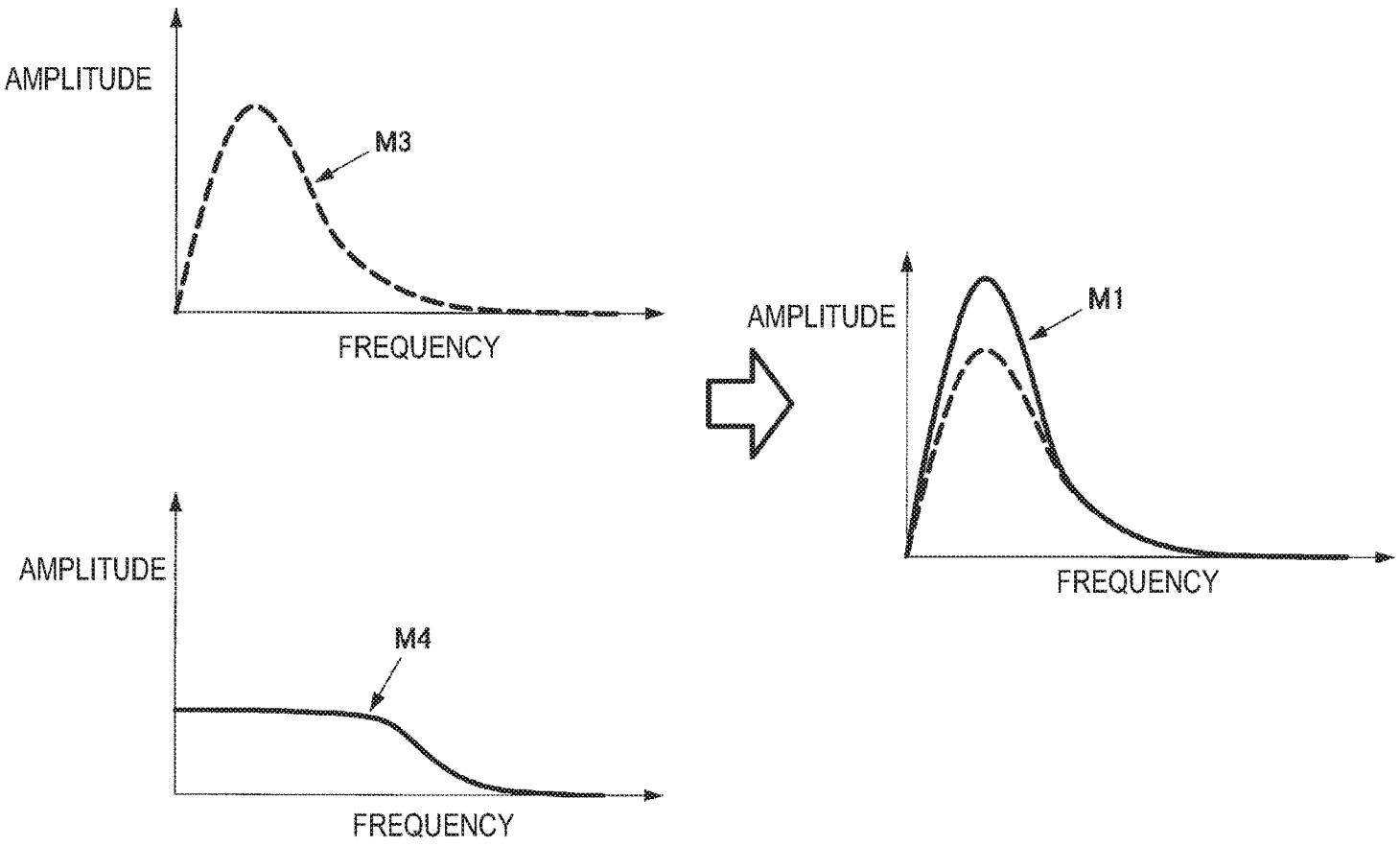
FIG. 8 is an explanatory diagram explaining processing of multiplication by a reproduction target transfer function using graphs.

FIG. 8 is an explanatory diagram explaining processing of multiplication by the reproduction target transfer function in the above-described step S113 using graphs. By frequency amplitude characteristics M3 of the audio signal 2 after FFT is executed on the audio signal 2 in the above-described step S112 being multiplied by the reproduction target transfer function M4, the analysis result M1 of the audio signal 2 which is the reproduction target characteristics can be obtained. In the example illustrated in FIG. 8, the reproduction target transfer function M4 is set so as to mainly amplify the low frequency domain. Therefore, the analysis result M1 of the audio signal 2 which is the reproduction target characteristics corresponds to characteristics obtained by amplifying the low frequency domain of the frequency amplitude characteristics M3 of the audio signal 2 by a predetermined amount.

After the signal processing apparatus 100 multiplies the audio signal 2 after FFT is executed in the above-described step S113 by the reproduction target transfer function to calculate the reproduction target characteristics, the signal processing apparatus 100 buffers the calculation result in the buffer 125 (step S114). The buffering in the buffer 125 in step S114 can be executed by, for example, the reproduction target characteristics calculating unit 122.

The analysis processing of the audio signal 2 in the above-described step S101 has been described above in detail using FIG. 7.

Figure 9:
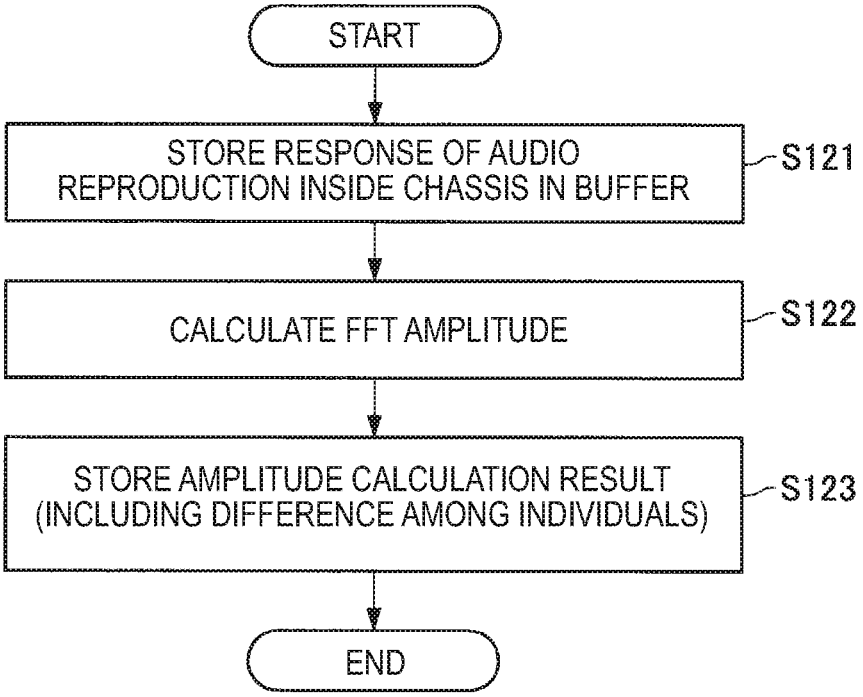
FIG. 9 is a flowchart illustrating an operation example of the signal processing apparatus 100 according to an embodiment of the present disclosure.

Subsequently, the processing of the above-described step S102 will be described in detail. FIG. 9 is a flowchart illustrating an operation example of the signal processing apparatus 100 according to one embodiment of the present disclosure. FIG. 9 illustrates a flowchart which explains the analysis processing of the response of the audio reproduction signal output from the microphone amplifier 104 in the above-described step S102 in detail.

The signal processing apparatus 100 first buffers the audio reproduction signal output from the microphone amplifier 104 in the buffer 125 when analyzing the response of the audio reproduction signal output from the microphone amplifier 104 (step S121). The audio reproduction signal is buffered in step S121 by, for example, the signal converting unit 121 buffering the audio reproduction signal in the buffer 125.

Figure 10:
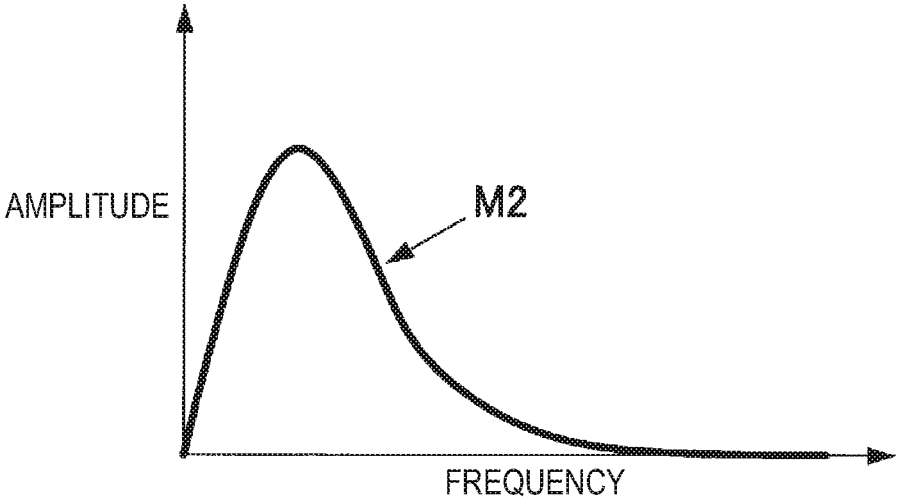
FIG. 10 is an explanatory diagram illustrating an example of a result of FFT execution performed on an audio reproduction signal.

Subsequently, the signal processing apparatus 100 executes FFT on the buffered audio reproduction signal and calculates amplitude for each frequency of the audio reproduction signal (step S122). The calculation of the amplitude in step S122 can be executed by, for example, the signal converting unit 121. FIG. 10 is an explanatory diagram illustrating an example of the execution result of FFT on the audio reproduction signal using a graph. The signal processing apparatus 100 obtains the analysis result M2 of the response of the audio reproduction signal by executing FFT on the audio reproduction signal. The analysis result M2 of the response of the audio reproduction signal is compared with the analysis result M1 of the audio signal 2 which is the reproduction target characteristics. That is, in the processing of step S103 in FIG. 7, a difference between the analysis result M1 of the audio signal 2 and the analysis result M2 of the response of the audio reproduction signal is calculated.

After the signal processing apparatus 100 calculates amplitude for each frequency of the audio reproduction signal, the signal processing apparatus 100 then buffers the calculation result in the buffer 125 (step S123). The calculation result is buffered in the buffer 125 in step S123 by, for example, the signal converting unit 121 buffering the calculation result in the buffer 125.

The analysis processing of the audio reproduction signal in the above-described step S102 has been described above in detail using FIG. 9.

A timing at which the above-described series of processing is executed is not limited to a specific timing. For example, the above-described series of processing may be executed at a time point at which the signal processing apparatus 100 is powered on, the above-described series of processing may be executed by the listener 1 sending an instruction at an arbitrary timing, or the above-described series of processing may be executed at a predetermined interval. When the above-described series of processing is executed at a time point at which the signal processing apparatus 100 is powered on, for example, the above-described series of processing may be executed using sound (start-up sound) output when the signal processing apparatus 100 is powered on. When start-up sound is used, because the signal processing apparatus 100 knows the reproduction target characteristics of the start-up sound in advance, it is possible to generate a noise canceling signal with higher accuracy.

Further, the signal processing apparatus 100 may detect that the listener 1 wears the headphone or that the listener 1 changes the position of the headphone, and may start the above-described series of processing by being triggered by the detection. For example, it is also possible to provide a sensor at the housing 10 and execute the above-described series of processing by being triggered by detection by the sensor that the listener 1 wears the headphone on his/her head.

The signal processing apparatus 100 according to one embodiment of the present disclosure can select a candidate for the personalized filter to be used at the sound quality adjusting filter 102 and the DNC personal adjusting filter 112 based on the difference from the reproduction target characteristics by executing the above-described series of processing. The signal processing apparatus 100 according to one embodiment of the present disclosure can allow the listener 1 to listen to the sound by the audio signal 2 with sound quality intended by the designer of the headphone regardless of the difference in how the listener 1 wears the headphone or the sealing level resulting from the physical characteristics of the listener 1 by selecting the candidate for the personalized filter to be used at the sound quality adjusting filter 102 and the DNC personal adjusting filter 112.

The operation example of the signal processing apparatus 100 according to one embodiment of the present disclosure has been described above. Subsequently, an application example of the technology described in the above-described embodiment will be described.

1.4. Application Example (1) Sound Quality Adjustment of Audio Signal

Figure 11:
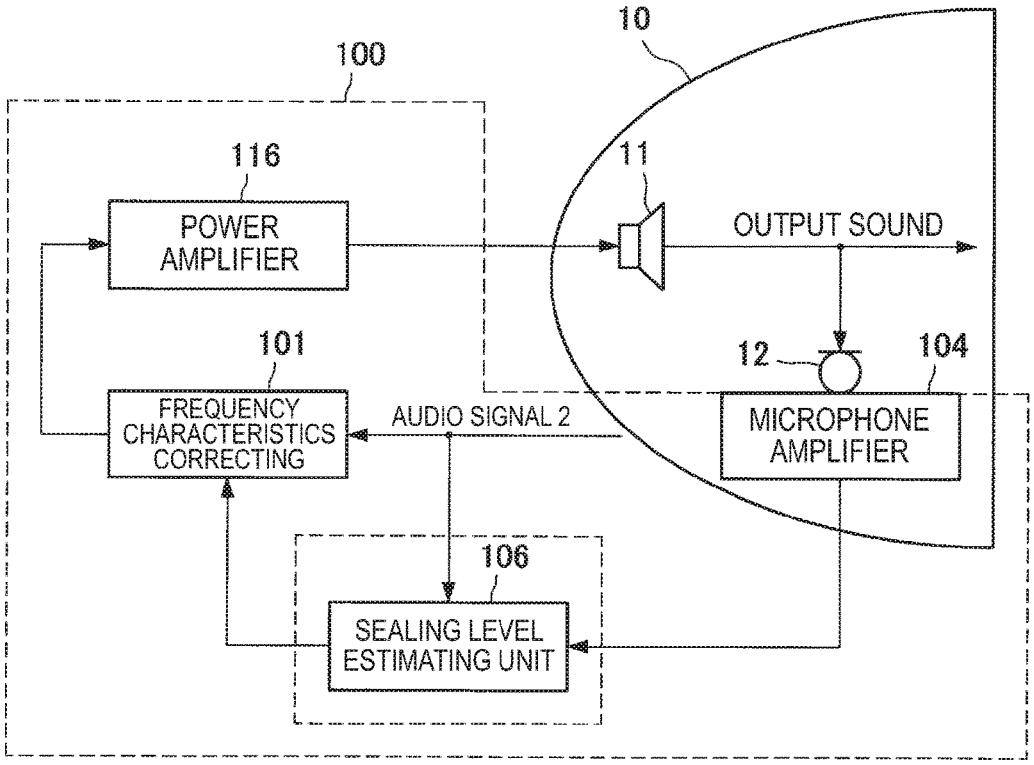
FIG. 11 is an explanatory diagram illustrating an example of an embodiment of the present disclosure.

First, an example in the case where the technology described in the above-described embodiment is applied to sound quality adjustment of the audio signal will be described. FIG. 11 is an explanatory diagram illustrating an example of one embodiment of the present disclosure. FIG. 11 illustrates a functional configuration example of the signal processing apparatus 100 which adjusts sound quality of the audio signal 2 so that the sound is output as intended by the designer of the headphone by comparing the audio signal 2 with the audio reproduction signal obtained by being collected at the microphone 12.

FIG. 11 illustrates a functional configuration example of the signal processing apparatus 100 in which components regarding digital noise canceling are removed from the functional configuration example of the signal processing apparatus 100 illustrated in FIG. 3. FIG. 11 illustrates a frequency characteristics correcting unit 101, a microphone amplifier 104, a sealing level estimating unit 106 and a power amplifier 116. The frequency characteristics correcting unit 101 which corrects the frequency characteristics of the audio signal 2 so that the sound as intended by the designer of the headphone is output, includes the sound quality adjusting filter 102 in FIG. 3.

By the signal processing apparatus 100 having the configuration illustrated in FIG. 11, the signal processing apparatus 100 can adjust sound quality of the audio signal 2 so that the sound as intended by the designer of the headphone is output by comparing the audio signal 2 with the audio reproduction signal obtained by being collected at the microphone 12. Therefore, by the signal processing apparatus 100 having the configuration illustrated in FIG. 11, the signal processing apparatus 100 can allow the listener 1 to listen to the sound by the audio signal 2 with sound quality intended by the designer of the headphone regardless of the difference in how the listener 1 wears the headphone or the sealing level resulting from the physical characteristics of the listener 1.

Figure 12:
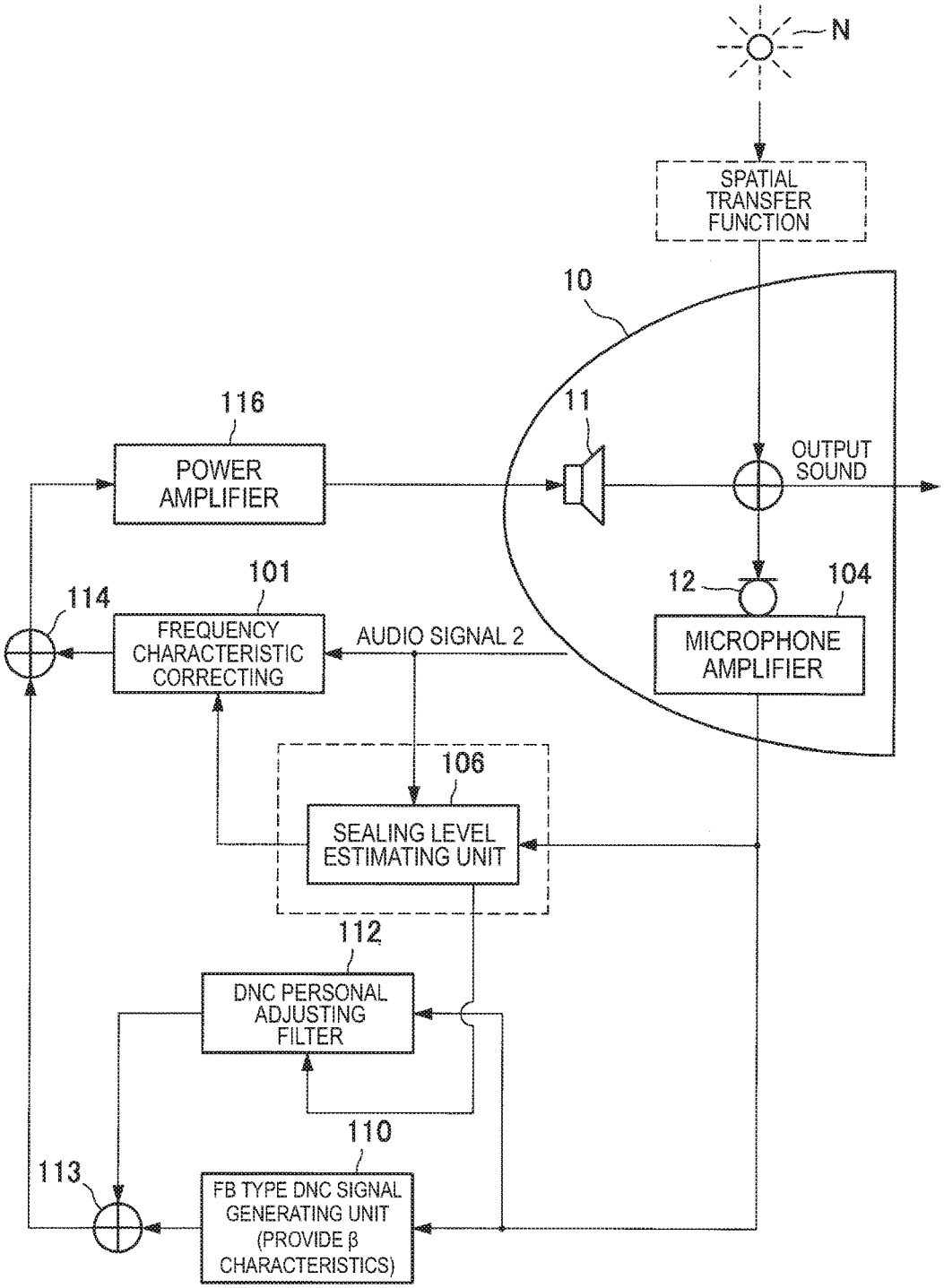
FIG. 12 is an explanatory diagram illustrating an example of an embodiment of the present disclosure.

(2) Sound Quality Adjustment of Audio Signal+(Feedback Type) Noise Canceling Processing Subsequently, an example in the case where the technology described in the above-described embodiment is applied to sound quality adjustment of the audio signal and noise canceling processing will be described. FIG. 12 is an explanatory diagram illustrating an example of one embodiment of the present disclosure. FIG. 12 illustrates a functional configuration example of the signal processing apparatus 100 which adjusts sound quality of the audio signal 2 so that the sound as intended by the designer of the headphone is output and which allows the listener to listen to sound in which noise is suppressed by comparing the audio signal 2 with the audio reproduction signal obtained by being collected at the microphone 12.

FIG. 12 illustrates a functional configuration example of the signal processing apparatus 100 in which part of the noise canceling processing in the functional configuration example of the signal processing apparatus 100 illustrated in FIG. 3 is changed from serial processing to parallel processing. FIG. 12 illustrates a frequency characteristics correcting unit 101, a microphone amplifier 104, a sealing level estimating unit 106, a DNC signal generating unit 110, a DNC personal adjusting filter 112, adders 113 and 114 and a power amplifier 116. Further, FIG. 12 also illustrates a noise source N which generates noise. The frequency characteristics correcting unit 101 which corrects the frequency characteristics of the audio signal 2 so that the sound as intended by the designer of the headphone is output as described above, includes the sound adjusting filter 102 in FIG. 3.

The DNC signal generating unit 110 generates a noise canceling signal while taking into account a spatial transfer function from the noise source N to inside (microphone 12) of the housing 10. The noise canceling signal can be generated by the DNC signal generating unit 110 by, for example, applying the technology disclosed in JP 2008-116782A, JP 2008-124792A, or the like, as described above. Further, the adder 113 adds the frequency characteristics of the noise canceling signal generated by the DNC signal generating unit 110 and the frequency characteristics of the personalized filter selected and output by the DNC personal adjusting filter 112.

By the signal processing apparatus 100 having the configuration illustrated in FIG. 12, the signal processing apparatus 100 can adjust sound quality of the audio signal 2 so that the sound as intended by the designer of the headphone is output and can select a candidate for the personalized filter to be used at the DNC personal adjusting filter 112 by comparing the audio signal 2 with the audio reproduction signal obtained by being collected at the microphone 12. Therefore, by the signal processing apparatus 100 having the configuration illustrated in FIG. 12, the signal processing apparatus 100 can allow the listener 1 to listen to the sound by the audio signal 2 with sound quality intended by the designer of the headphone while noise from the noise source is effectively reduced through feedback type noise canceling processing regardless of the difference in how the listener 1 wears the headphone or the sealing level resulting from the physical characteristics of the listener 1.

Figure 13:
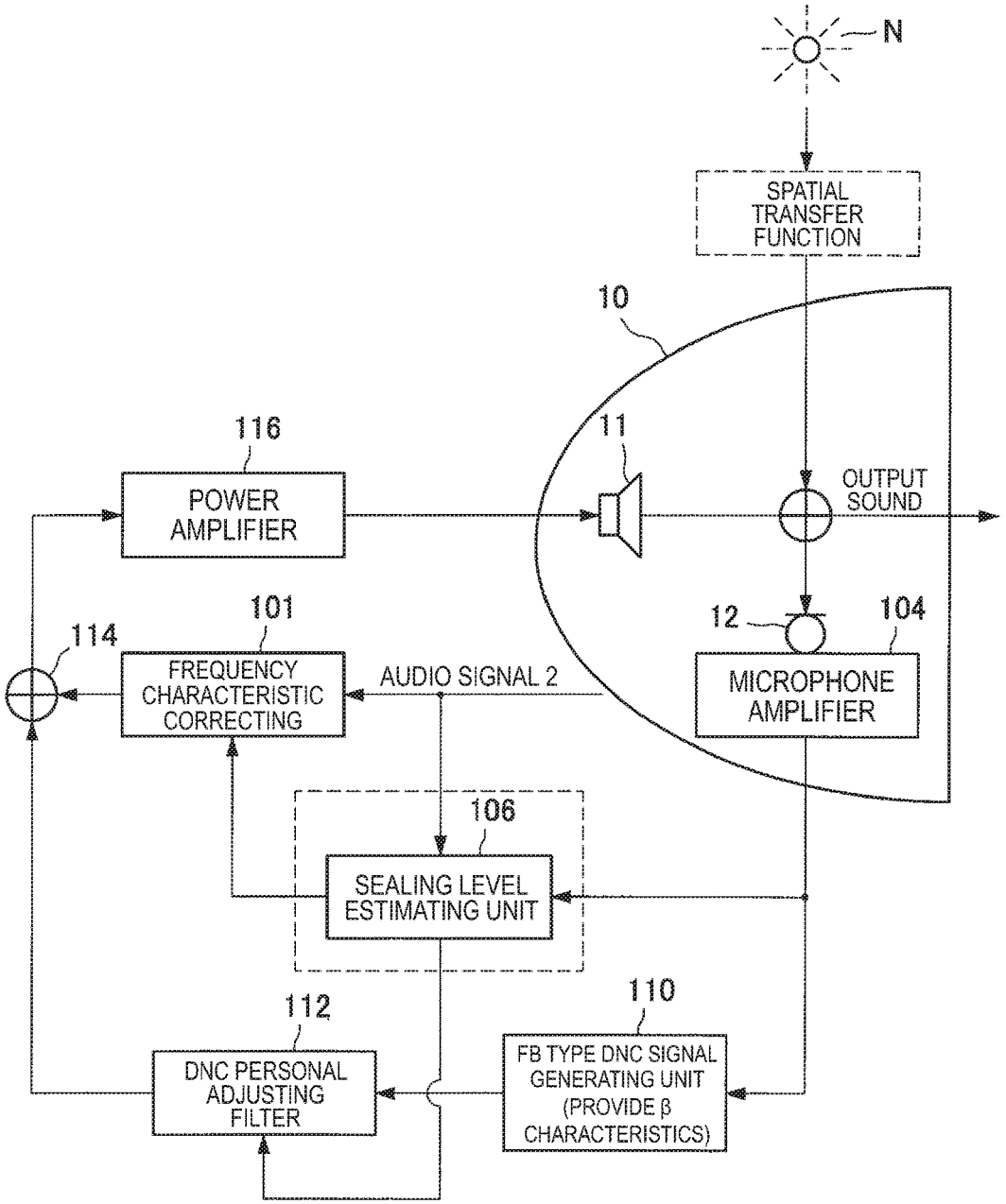
FIG. 13 is an explanatory diagram illustrating an example of an embodiment of the present disclosure.

While FIG. 12 illustrates the functional configuration example of the signal processing apparatus 100 in the case where the noise canceling processing is performed in parallel, the noise canceling processing may be performed in series. FIG. 13 is an explanatory diagram illustrating an example of one embodiment of the present disclosure. FIG. 13 illustrates a functional configuration example of the signal processing apparatus 100 which adjusts sound quality of the audio signal 2 so that the sound as intended by the designer of the headphone is output and which allows the listener to listen to sound in which noise is suppressed by comparing the audio signal 2 with the audio reproduction signal obtained by being collected at the microphone 12.

FIG. 13 illustrates a functional configuration example of the signal processing apparatus 100 in which part of the noise canceling processing is serial processing as in the functional configuration example of the signal processing apparatus 100 illustrated in FIG. 3. In this manner, even when part of the noise canceling processing is serial processing, the signal processing apparatus 100 can adjust sound quality of the audio signal 2 so that the sound as intended by the designer of the headphone is output and can select a candidate for the personalized filter to be used at the DNC personal adjusting filter 112 by comparing the audio signal 2 with the audio reproduction signal obtained by being collected at the microphone 12.

Therefore, by the signal processing apparatus 100 having the configuration illustrated in FIG. 13, the signal processing apparatus 100 can allow the listener 1 to listen to the sound by the audio signal 2 with sound quality intended by the designer of the headphone while effectively reducing noise from the noise source through the feedback type noise canceling processing regardless of the difference in how the listener 1 wears the headphone or the sealing level resulting from the physical characteristics of the listener 1.

(3) Sound Adjustment of Audio Signal+(Feedforward Type) Noise Canceling Processing The example in the case where the technology described in the above-described embodiment is applied to the feedback type noise canceling processing has been described so far. Subsequently, an example in the case where the technology described in the above-described embodiment is applied to feedforward type noise canceling processing will be described. The feedforward type noise canceling processing is processing of collecting noise generated from the noise source using a microphone provided outside instead of using the microphone provided inside the housing of the headphone, generating a noise canceling signal which cancels out the noise and synthesizing the noise canceling signal with the audio signal.

Figure 14:
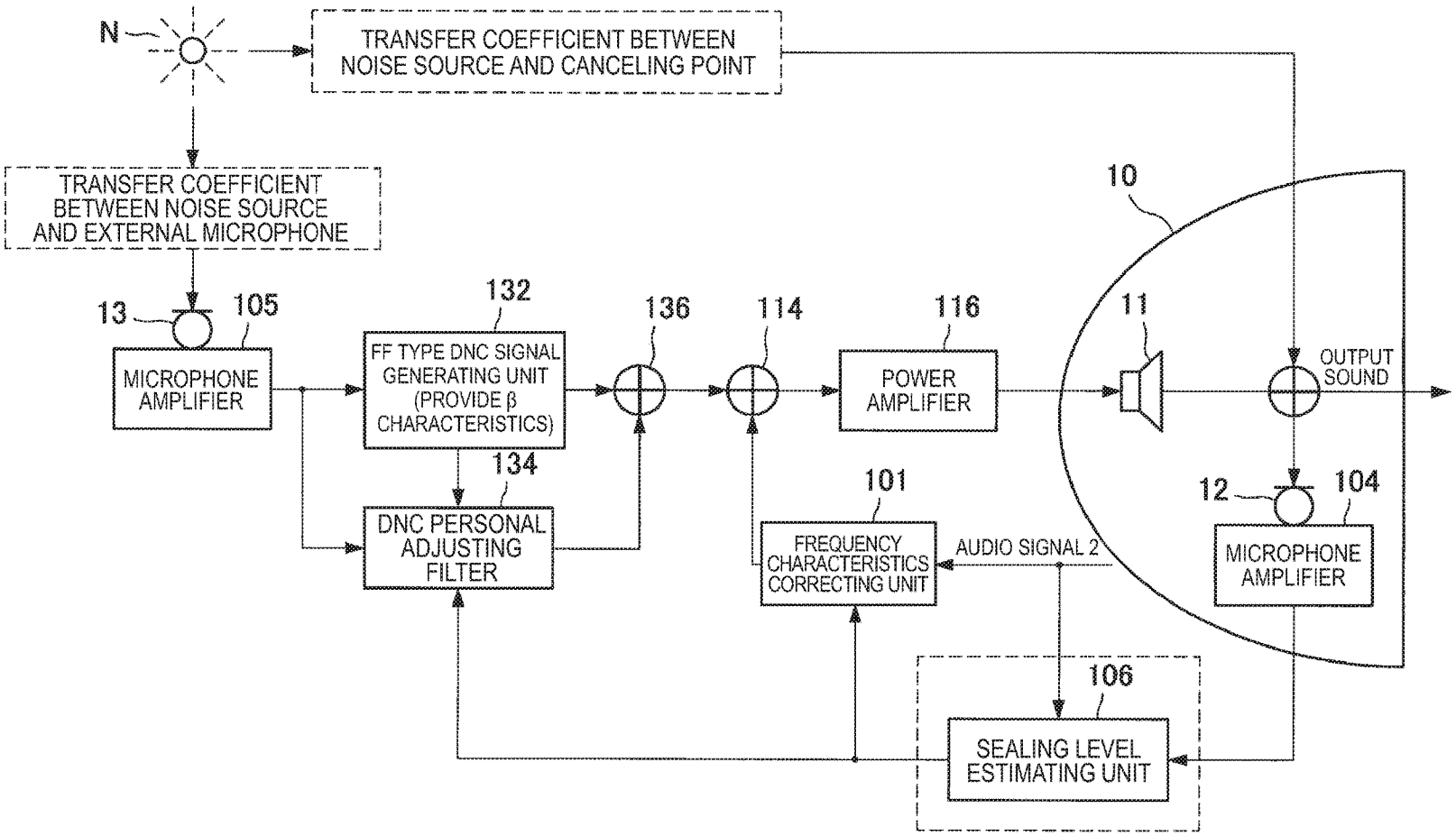
FIG. 14 is an explanatory diagram illustrating an example of an embodiment of the present disclosure.

FIG. 14 is an explanatory diagram illustrating an example of one embodiment of the present disclosure. FIG. 14 illustrates a functional configuration example of the signal processing apparatus 100 which adjusts sound quality of the audio signal 2 so that the sound as intended by the designer of the headphone is output and which allows the listener to listen to sound in which noise is suppressed by comparing the audio signal 2 with the audio reproduction signal obtained by being collected at the microphone 12. The signal processing apparatus 100 illustrated in FIG. 14 performs feedforward type noise canceling processing.

FIG. 14 illustrates a functional configuration example of the signal processing apparatus 100 in which part of the noise canceling processing in the functional configuration example of the signal processing apparatus 100 illustrated in FIG. 3 is changed to feedforward type noise canceling processing. FIG. 14 illustrates a frequency characteristics correcting unit 101, microphone amplifiers 104 and 105, a sealing level estimating unit 106, a DNC signal generating unit 132, a DNC personal adjusting filter 134, adders 114 and 136 and a power amplifier 116. Further, FIG. 14 also illustrates a noise source N which generates noise, and a microphone 13 which collects noise generated by the noise source N outside the housing 10. The frequency characteristics correcting unit 101 which corrects the frequency characteristics of the audio signal 2 so that the sound as intended by the designer of the headphone is output as described above, includes the sound quality adjusting filter 102 in FIG. 3.

The DNC signal generating unit 132 generates a noise canceling signal while taking into account a spatial transfer function from the noise source N to the microphone 13 and inside (microphone 12) of the housing 10. The technology disclosed in, for example, JP 2008-116782A, JP 2008-124792A, or the like, can be applied to the generation of the noise canceling signal using the fordforward type noise canceling processing by the DNC signal generating unit 132 as described above.

The DNC personal adjusting filter 134 selects a personalized filter based on the difference between the reproduction target characteristics intended by the designer of the headphone and the characteristics of the audio reproduction signal as with the above-described DNC personal adjusting filter 112. The DNC personal adjusting filter 134 outputs the frequency characteristics of the personalized filter selected based on the difference between the reproduction target characteristics intended by the designer of the headphone and the characteristics of the audio reproduction signal to the adder 136.

The adder 136 adds the frequency characteristics of the noise canceling signal generated by the DNC signal generating unit 132 and the frequency characteristics of the personalized filter selected and output by the DNC personal adjusting filter 134.

By the signal processing apparatus 100 having the configuration illustrated in FIG. 14, the signal processing apparatus 100 can adjust sound quality of the audio signal 2 so that the sound as intended by the designer of the headphone is output and can select a candidate for the personalized filter to be used at the DNC personal adjusting filter 134 by comparing the audio signal 2 with the audio reproduction signal obtained by being collected at the microphone 12.

Therefore, by the signal processing apparatus 100 having the configuration illustrated in FIG. 14, the signal processing apparatus 100 can allow the listener 1 to listen to the sound by the audio signal 2 with sound quality intended by the designer of the headphone while effectively reducing noise from the noise source N through the feedforward type noise canceling processing regardless of the difference in how the listener 1 wears the headphone or the sealing level resulting from the physical characteristics of the listener 1.

While FIG. 14 illustrates the functional configuration example of the signal processing apparatus 100 in the case where the DNC signal generating unit 132 and the DNC personal adjusting filter 134 are connected in parallel, the present disclosure is not limited to this example. The DNC signal generating unit 132 and the DNC personal adjusting filter 134 may be connected in series.

Figure 15:
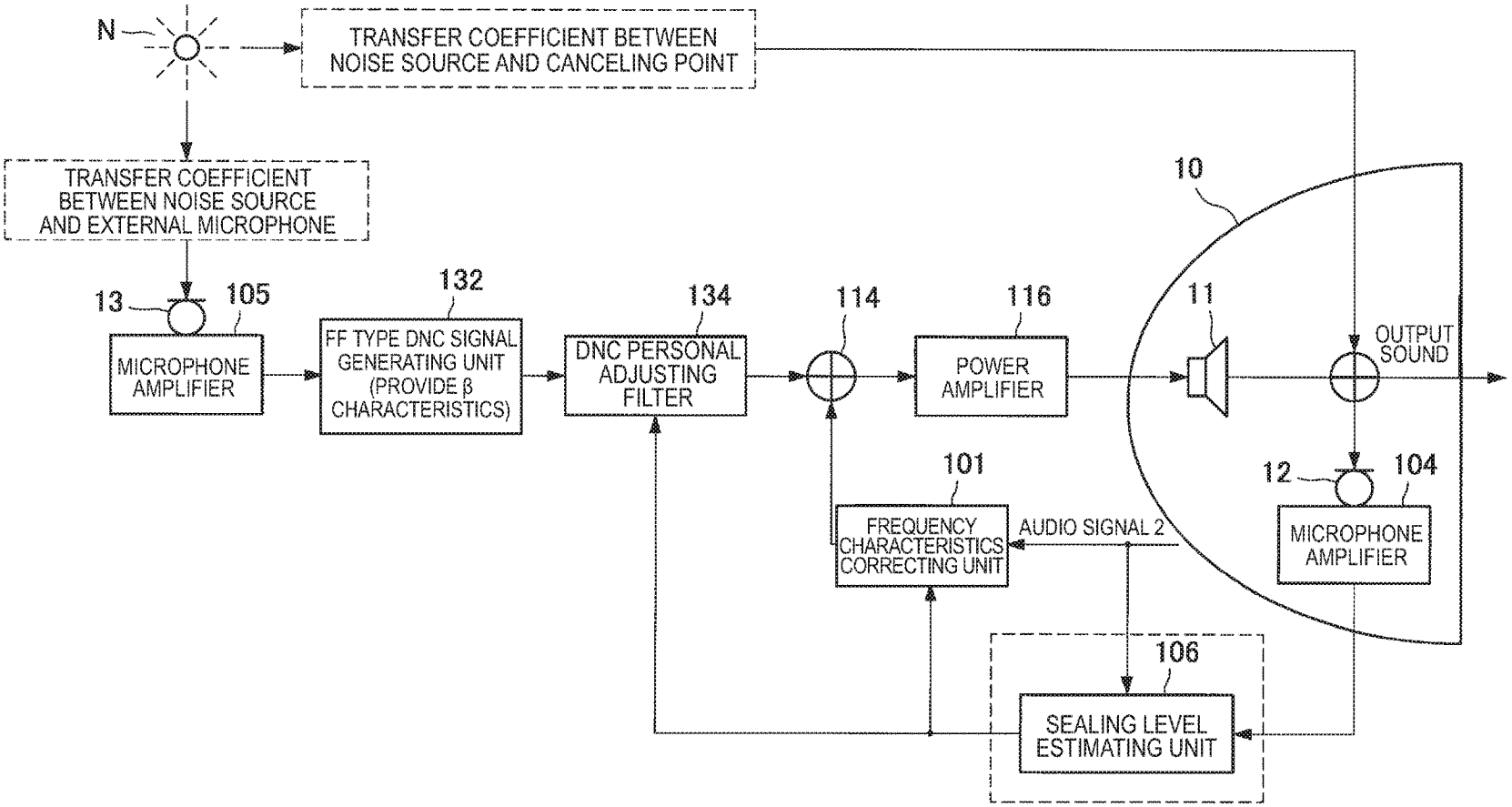
FIG. 15 is an explanatory diagram illustrating an example of an embodiment of the present disclosure.

FIG. 15 is an explanatory diagram illustrating an example of one embodiment of the present disclosure. FIG. 15 illustrates a functional configuration example of the signal processing apparatus 100 which adjusts sound quality of the audio signal 2 so that the sound as intended by the designer of the headphone is output and which allows the listener to listen to sound in which noise is suppressed by comparing the audio signal 2 with the audio reproduction signal obtained by being collected at the microphone 12. The signal processing apparatus 100 illustrated in FIG. 15 performs feedforward type noise canceling processing.

FIG. 15 illustrates a functional configuration example of the signal processing apparatus 100 in which parallel connection of the DNC signal generating unit 132 and the DNC personal adjusting filter 134 in the functional configuration example of the signal processing apparatus 100 illustrated in FIG. 14 is changed to serial connection.

As illustrated in FIG. 15, even when the DNC signal generating unit 132 and the DNC personal adjusting filter 134 are connected in series, the signal processing apparatus 100 illustrated in FIG. 15 can adjust sound quality of the audio signal 2 so that the sound as intended by the designer of the headphone is output and can select a candidate for the personalized filter to be used at the DNC personal adjusting filter 134 by comparing the audio signal 2 with the audio reproduction signal obtained by being collected at the microphone 12.

Therefore, by the signal processing apparatus 100 having the configuration illustrated in FIG. 15, the signal processing apparatus 100 can allow the listener 1 to listen to the sound by the audio signal 2 with sound quality intended by the designer of the headphone while effectively reducing noise from the noise source N through the feedforward type noise canceling processing regardless of the difference in how the listener 1 wears the headphone or the sealing level resulting from the physical characteristics of the listener 1.

(4) Sound Quality Adjustment of Audio Signal+Noise Canceling Processing (Combination of Feedback Type and Feedforward Type)

The example in the case where the technology described in the above-described embodiment is applied to the feedforward type noise canceling processing has been described so far. Subsequently, an example in the case where the technology described in the above-described embodiment is applied to noise canceling processing in which feedback type noise canceling processing and feedforward type noise canceling processing are combined.

The noise canceling processing in which the feedback type noise canceling processing and feedforward type noise canceling processing are combined is processing of switching between the feedback type noise canceling processing and the feedforward type noise canceling processing according to a position of the noise source. Outline of the noise canceling processing in which the feedback type noise canceling processing and feedforward type noise canceling processing are combined is described in, for example, JP 2008-116782A. By combining the feedback type noise canceling processing and the feedforward type noise canceling processing, it is possible to perform noise canceling stably over a wide band and effectively perform noise canceling also on noise leaking into the headphone chassis.

FIG. 16 to FIG. 19 are explanatory diagrams illustrating examples of one embodiment of the present disclosure. FIG. 16 to FIG. 19 illustrate functional configuration examples of the signal processing apparatus 100 which adjusts sound quality of the audio signal 2 so that the sound as intended by the designer of the headphone is output and which allows the listener to listen to sound in which noise is suppressed by comparing the audio signal 2 with the audio reproduction signal obtained by being collected at the microphone 12. The signal processing apparatus 100 illustrated in FIG. 16 to FIG. 19 performs noise canceling processing in which the feedback type noise canceling processing and the feedforward type noise canceling processing are combined.

Figure 16:
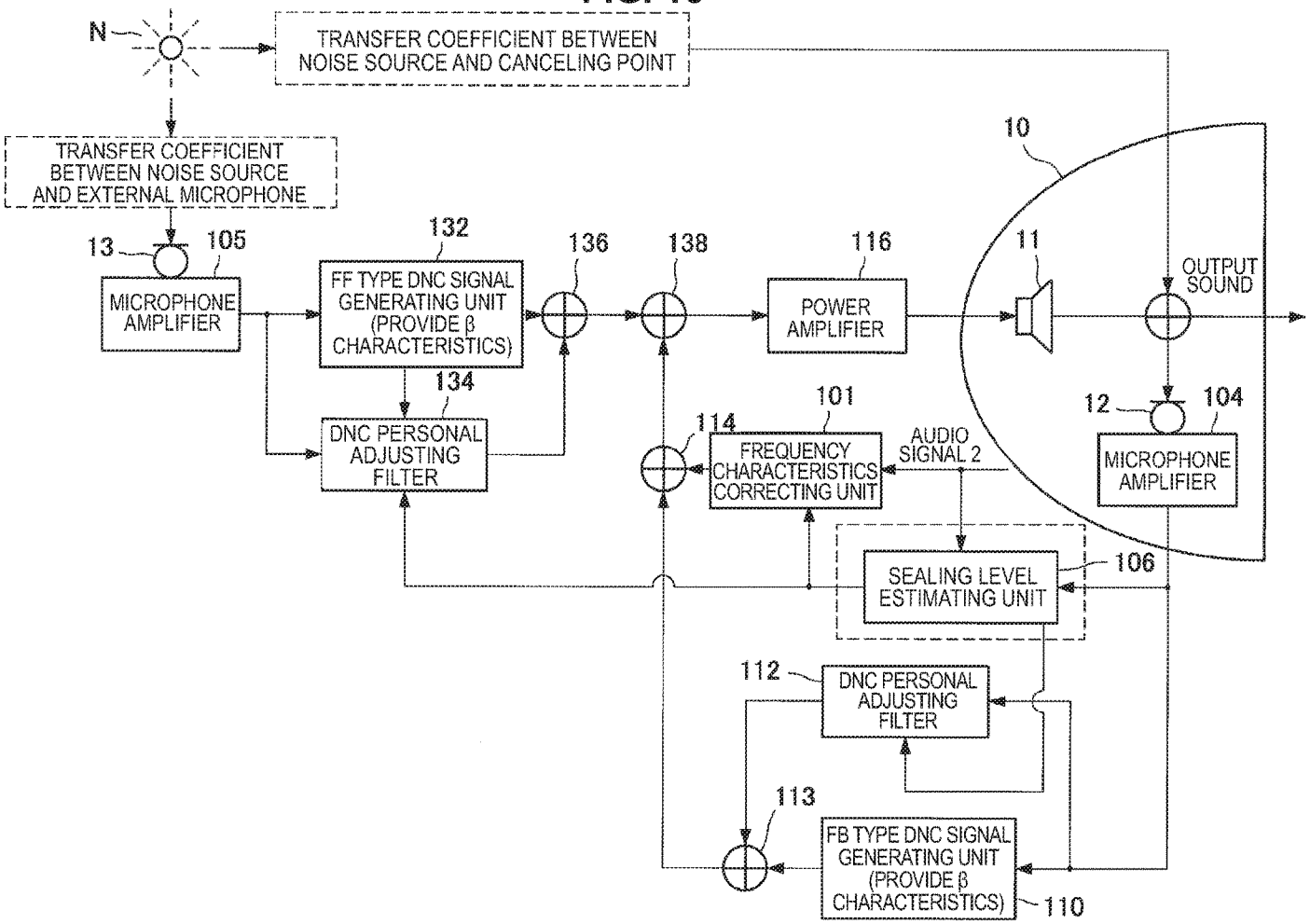
FIG. 16 is an explanatory diagram illustrating an example of an embodiment of the present disclosure.

The part which performs noise canceling processing in the signal processing apparatus 100 illustrated in FIG. 16 corresponds to a configuration in which the signal processing apparatus 100 which performs feedback type noise canceling processing illustrated in FIG. 12 and the signal processing apparatus 100 which performs feedforward type noise canceling processing illustrated in FIG. 14 are combined. That is, in the part which performs noise canceling processing in the signal processing apparatus 100 illustrated in FIG. 16, the DNC signal generating unit 110 and the DNC personal adjusting filter 112 are connected in parallel, and the DNC signal generating unit 132 and the DNC personal adjusting filter 134 are also connected in parallel.

Figure 17:
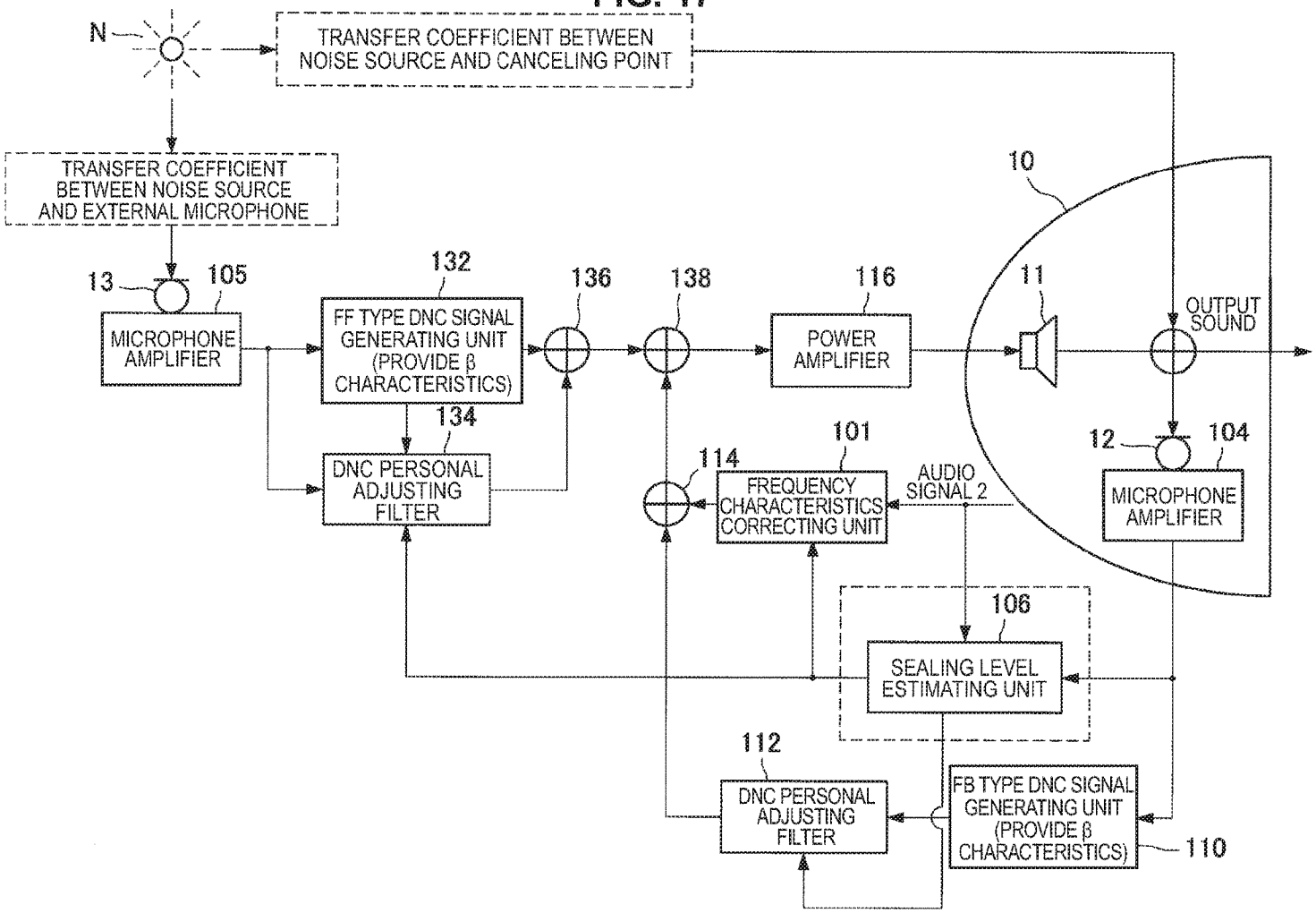
FIG. 17 is an explanatory diagram illustrating an example of an embodiment of the present disclosure.

The part which performs noise canceling processing in the signal processing apparatus 100 illustrated in FIG. 17 corresponds to a configuration in which the signal processing apparatus 100 which performs feedback type noise canceling processing illustrated in FIG. 13 and the signal processing apparatus 100 which performs feedforward type noise canceling processing illustrated in FIG. 14 are combined. That is, in the part which performs noise canceling processing in the signal processing apparatus 100 illustrated in FIG. 17, the DNC signal generating unit 110 and the DNC personal adjusting filter 112 are connected in series, and the DNC signal generating unit 132 and the DNC persona adjusting filter 134 are connected in parallel.

Figure 18:
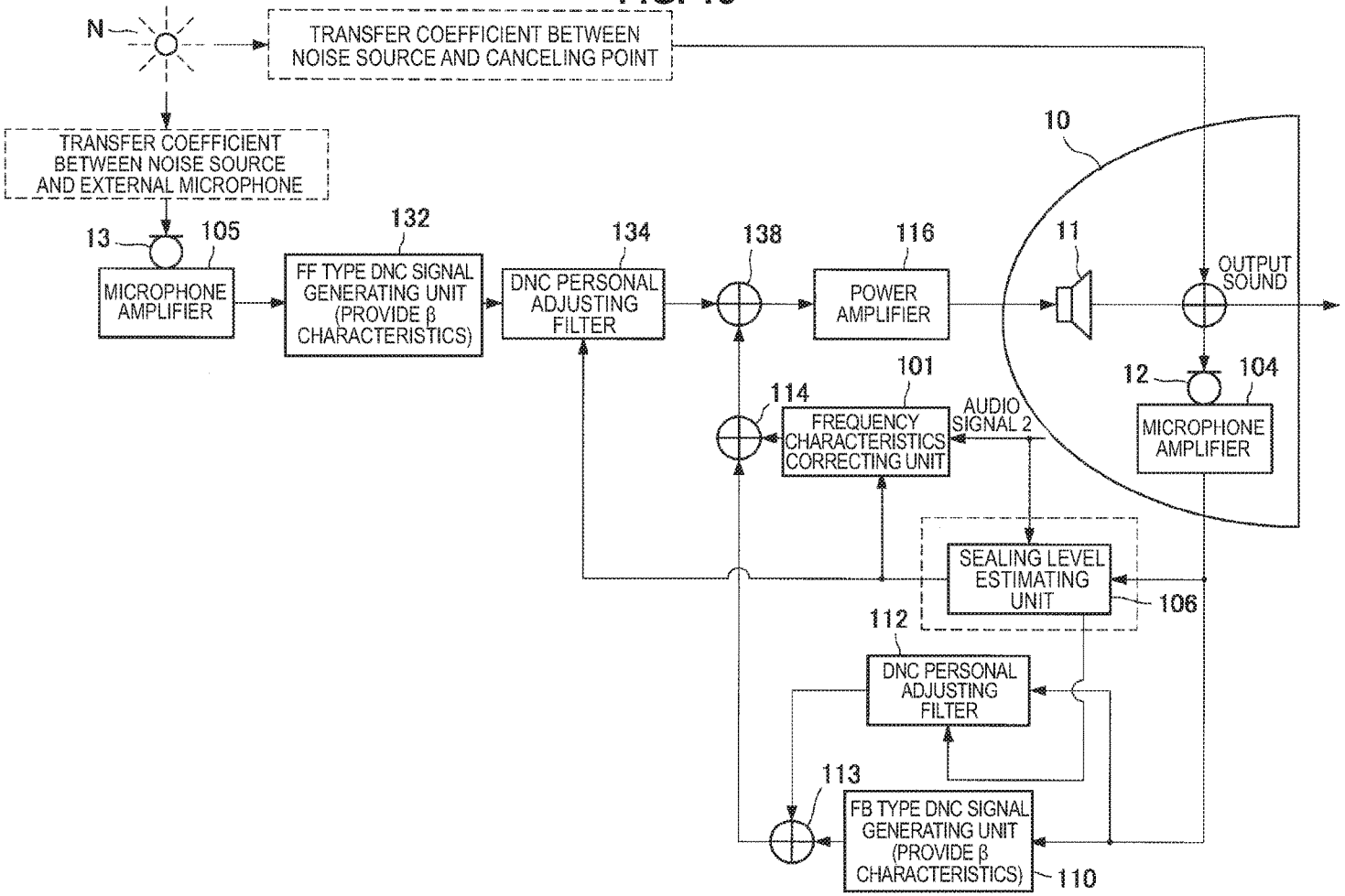
FIG. 18 is an explanatory diagram illustrating an example of an embodiment of the present disclosure.

The part which performs noise canceling processing in the signal processing apparatus 100 illustrated in FIG. 18 corresponds to a configuration in which the signal processing apparatus 100 which performs feedback type noise canceling processing illustrated in FIG. 12 and the signal processing apparatus 100 which performs feedforward type noise canceling processing illustrated in FIG. 15 are combined. That is, in the part which performs noise canceling processing in the signal processing apparatus 100 illustrated in FIG. 18, the DNC signal generating unit 110 and the DNC personal adjusting filter 112 are connected in parallel, and the DNC signal generating unit 132 and the DNC personal adjusting filter 134 are connected in series.

Figure 19:
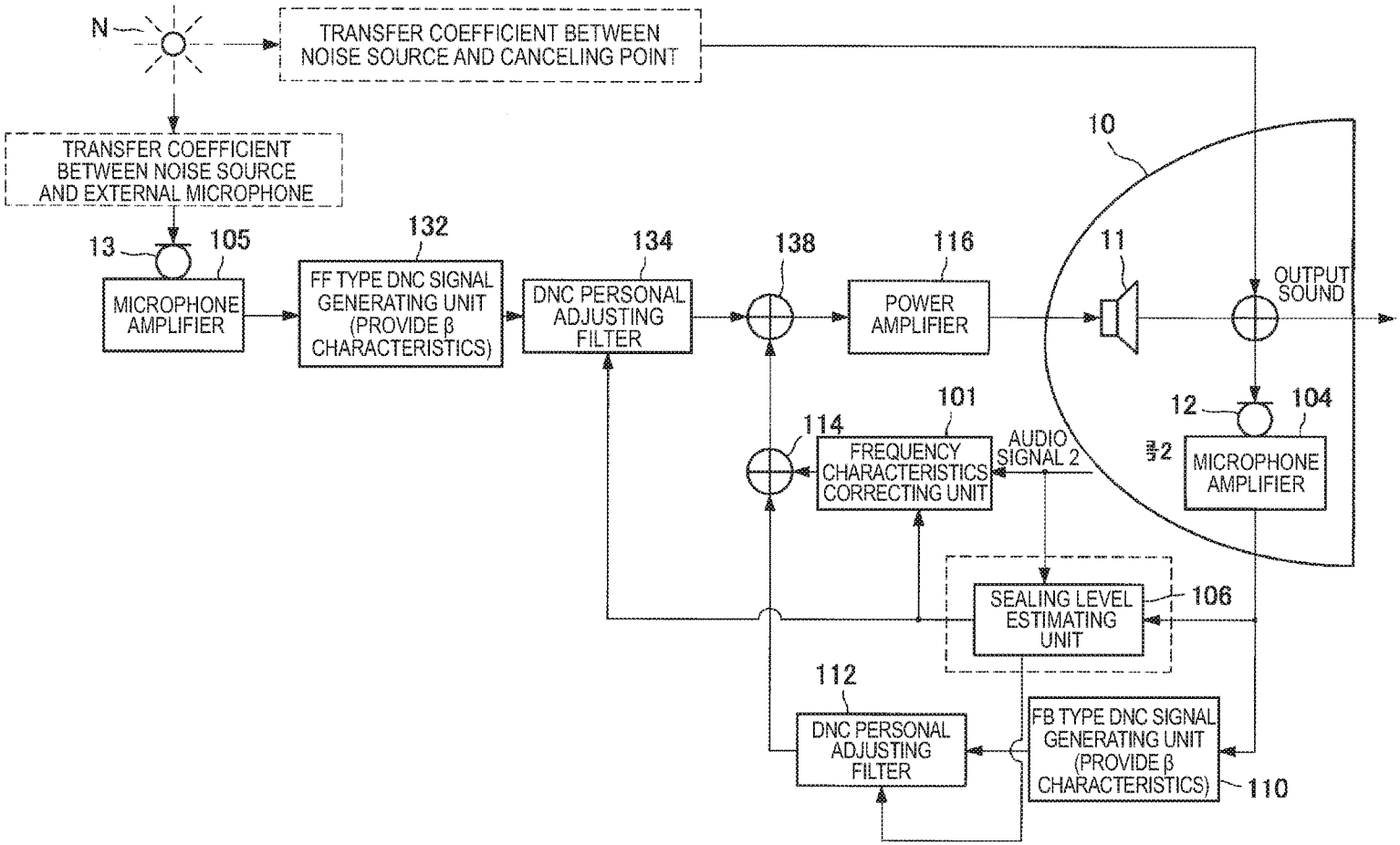
FIG. 19 is an explanatory diagram illustrating an example of an embodiment of the present disclosure.

The part which performs noise canceling processing in the signal processing apparatus 100 illustrated in FIG. 19 corresponds to a configuration in which the signal processing apparatus 100 which performs feedback type noise canceling processing illustrated in FIG. 13 and the signal processing apparatus 100 which performs feedforward type noise canceling processing illustrated in FIG. 15 are combined. That is, in the part which performs noise canceling processing in the signal processing apparatus 100 illustrated in FIG. 16, the DNC signal generating unit 110 and the DNC personal adjusting filter 112 are connected in series, and the DNC signal generating unit 132 and the DNC personal adjusting filter 134 are also connected in series.

The signal processing apparatus 100 having the configuration as illustrated in FIG. 16 to FIG. 19 can adjust sound quality of the audio signal 2 so that the sound as intended by the designer of the headphone is output and can select a candidate for the personalized filter to be used at the DNC personal adjusting filter 134 by comparing the audio signal 2 with the audio reproduction signal obtained by being collected at the microphone 12.

Therefore, by the signal processing apparatus 100 having the configuration illustrated in FIG. 16 to FIG. 19, the signal processing apparatus 100 can allow the listener 1 to listen to the sound by the audio signal 2 with sound quality intended by the designer of the headphone while effectively reducing noise from the noise source N through feedforward type noise canceling processing regardless of the difference in how the listener 1 wears the headphone or the sealing level resulting from the physical characteristics of the listener 1.

Note that, while FIG. 16 to FIG. 19 illustrate examples where the technology according to one embodiment of the present disclosure is applied to the signal processing apparatus 100 which performs noise canceling processing in which the feedback type noise canceling processing and the feedforward type noise canceling processing are combined, the technology according to one embodiment of the present disclosure can be also applied to a noise canceling system which performs noise canceling processing by selecting one of the feedback type noise canceling processing and the feedforward type noise canceling processing, while the feedback type noise canceling processing and the feedforward type noise canceling processing are combined as a block configuration.

Further, the above-described noise canceling processing may be replaced with noise canceling processing which realizes reduction of noise by combining an analog signal and a digital signal as disclosed in, for example, JP 2008-124792A. The technology according to one embodiment of the present disclosure may be applied to generation of a noise canceling signal by the digital signal in the noise canceling processing.

2. Conclusion

As described above, according to one embodiment of the present disclosure, the signal processing apparatus 100 which compares the reproduction target characteristics obtained based on the audio signal with the characteristics of the audio reproduction signal output from the driver of the headphone is provided. The signal processing apparatus 100 according to one embodiment of the present disclosure can select a candidate for the personalized filter to be used at the sound quality adjusting filter 102 and the DNC personal adjusting filter 112 based on the difference of the characteristics of the audio reproduction signal from the reproduction target characteristics by comparing the reproduction target characteristics with the characteristics of the audio reproduction signal. The signal processing apparatus 100 according to one embodiment of the present disclosure can allow the listener 1 to listen to the sound by the audio signal 2 with sound quality intended by the designer of the headphone regardless of the difference in how the listener 1 wears the headphone or the sealing level resulting from the physical characteristics of the listener 1 by selecting the candidate for the personalized filter to be used at the sound quality adjusting filter 102 and the DNC personal adjusting filter 112.

Further, the signal processing apparatus 100 according to the above-described embodiment can be mounted on, for example, a portable music player, a smartphone, a tablet mobile terminal, portable game machine, or the like.

Steps in processes executed by devices in this specification are not necessarily executed chronologically in the order described in a sequence chart or a flow chart. For example, steps in processes executed by devices may be executed in a different order from the order described in a flow chart or may be executed in parallel.

Further, a computer program can be created which causes hardware such as a CPU, ROM, or RAM, incorporated in each of the devices, to function in a manner similar to that of structures in the above-described devices. Furthermore, it is possible to provide a recording medium having the computer program recorded thereon. Moreover, by configuring respective functional blocks shown in a functional block diagram as hardware, the hardware can achieve a series of processes.

Note that software that realizes a user interface or an application shown in the above-described embodiments may be realized as a web application that is used via a network such as the Internet. Such a web application may be realized with a markup language, for example, HyperText Markup Language (HTML), Standard Generalized Markup Language (SGML), Extensible Markup Language (XML), or the like.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art based on the description of this specification.

For example, when the signal processing apparatus 100 according to the above-described embodiment recognizes that there is a difference of a predetermined amount or greater between the reproduction target characteristics and the frequency characteristics of the audio reproduction signal, the signal processing apparatus 100 according to the above-described embodiment may output warning or log indicating that there is a difference. The warning indicating that there is a difference may be output as characters, an image, an icon, or the like, on a display of equipment on which the signal processing apparatus 100 according to the above-described embodiment is mounted or may be output as sound from the headphone.

For example, the signal processing apparatus 100 according to the above-described embodiment may output the above-described warning or log when there is a difference of a predetermined amount or greater between the reproduction target characteristics and the frequency characteristics of the audio reproduction signal and when the difference cannot be corrected although using the personalized filter.

Additionally, the present technology may also be configured as below.

(1)

A signal processing apparatus including:

a characteristics difference calculating unit configured to calculate a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and a sound signal processing unit configured to select a parameter to be used at the signal processing based on the difference calculated by the characteristics difference calculating unit, and perform signal processing on the first sound signal.

(2)

The signal processing apparatus according to (1), wherein the parameter selected by the sound signal processing unit is a parameter of a filter to be used for adjustment of sound quality of the first sound signal.

(3)

The signal processing apparatus according to (2), wherein the sound signal processing unit selects one parameter on the basis of the difference, among parameters of the filter set in advance.

(4)

The signal processing apparatus according to any of (1) to (3), wherein the parameter selected by the sound signal processing unit is a parameter of a filter to be used for noise reduction processing of the first sound signal.

(5)

The signal processing apparatus according to (4), wherein the sound signal processing unit selects one parameter on the basis of the difference, among parameters of the filter set in advance.

(6)

The signal processing apparatus according to (4) or (5), wherein the noise reduction processing is feedback type noise reduction processing.

(7)

The signal processing apparatus according to (4) or (5), wherein the noise reduction processing is feedforward type noise reduction processing.

(8)

The signal processing apparatus according to (4) or (5), wherein the noise reduction processing is combination of feedback type noise reduction processing and feedforward type noise reduction processing.

(9)

The signal processing apparatus according to any of (1) to (8), wherein the characteristics difference calculating unit calculates the difference between the reproduction target characteristics and the characteristics of the second sound signal by comparing frequency characteristics of the first sound signal with frequency characteristics of the second sound signal.

(10)

The signal processing apparatus according to any of (1) to (9), wherein the characteristics difference calculating unit calculates the difference between the reproduction target characteristics and the characteristics of the second sound signal at a predetermined interval.

(11)

The signal processing apparatus according to any of (1) to (10), wherein the characteristics difference calculating unit calculates the difference between the reproduction target characteristics and the characteristics of the second sound signal at a time point at which it is detected that the headphone is worn.

(12)

The signal processing apparatus according to any of (1) to (11), wherein the difference between the reproduction target characteristics and the characteristics of the second sound signal results from an individual difference among wearers of the headphone.

(13)

The signal processing apparatus according to any of (1) to (12), wherein the difference between the reproduction target characteristics and the characteristics of the second sound signal results from variation in how the wearer wears the headphone.

(14)

A signal processing method including:

calculating a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and selecting a parameter to be used for the signal processing based on the calculated difference.

(15)

A computer program causing a computer to execute:

calculation of a difference between reproduction target characteristics of a first sound signal and characteristics of a second sound signal obtained by collecting, at a microphone provided inside a headphone, sound output from a driver which outputs the sound based on a third sound signal obtained by performing signal processing on the first sound signal; and selection of a parameter to be used for the signal processing based on the calculated difference.

REFERENCE SIGNS LIST

1 listener
2 audio signal
10 housing
11 driver
12 microphone
13 microphone
100 signal processing apparatus
102 sound quality adjusting filter
104 microphone amplifier
106 sealing level estimating unit
108 DNC signal generating unit
110 DNC signal generating unit
112 DNC personal adjusting filter
113 adder
114 adder
116 power amplifier
121 signal converting unit
122 reproduction target characteristics calculating unit
123 difference calculating unit
124 candidate selecting unit
125 buffer

The invention claimed is:

1. A signal processing apparatus, comprising:

a characteristics difference calculating unit configured to calculate a difference between reproduction target characteristics of a first sound signal and characteristics of a second sound signal, wherein the second sound signal is obtained by collection of, by a microphone inside a headphone, sound output from a driver of the headphone, wherein the driver outputs the sound based on a third sound signal, and wherein the third sound signal is obtained by execution of a first signal processing on the first sound signal; and a sound signal processing unit configured to:

select a first parameter for a first filter configured to adjust sound quality of the first sound signal and a second parameter for a second filter configured to execute noise reduction processing of the second sound signal, wherein the first parameter and the second parameter are selected based on the difference calculated by the characteristics difference calculating unit, and wherein the first filter is different from the second filter; and execute a second signal processing on the first sound signal, wherein the difference between the reproduction target characteristics of the first sound signal and the characteristics of the second sound signal is based on a difference in physical characteristics of wearers of the headphone.

2. The signal processing apparatus according to claim 1, wherein the sound signal processing unit is further configured to select the first parameter from parameters of the first filter set in advance.

3. The signal processing apparatus according to claim 1, wherein the sound signal processing unit is further configured to select the second parameter from parameters of the second filter set in advance.

4. The signal processing apparatus according to claim 1, wherein the noise reduction processing is feedback type noise reduction processing.

5. The signal processing apparatus according to claim 1, wherein the noise reduction processing is feedforward type noise reduction processing.

6. The signal processing apparatus according to claim 1, wherein the noise reduction processing is combination of feedback type noise reduction processing and feedforward type noise reduction processing.

7. The signal processing apparatus according to claim 1, wherein the characteristics difference calculating unit is further configured to calculate the difference between the reproduction target characteristics and the characteristics of the second sound signal by comparison of frequency characteristics of the first sound signal with frequency characteristics of the second sound signal.

8. The signal processing apparatus according to claim 1, wherein the characteristics difference calculating unit is further configured to calculate the difference between the reproduction target characteristics and the characteristics of the second sound signal at a determined interval.

9. The signal processing apparatus according to claim 1, wherein the characteristics difference calculating unit is further configured to calculate the difference between the reproduction target characteristics and the characteristics of the second sound signal based on a time of detection that the headphone is worn.

10. The signal processing apparatus according to claim 1, wherein the difference between the reproduction target characteristics and the characteristics of the second sound signal is based on variation in a sealing level, and wherein the sealing level indicates a space between a head of each of the wearers and a housing of the headphone.

11. A signal processing method, comprising:

calculating a difference between reproduction target characteristics of a first sound signal and characteristics of a second sound signal, wherein the second sound signal is obtained by collecting, by a microphone inside a headphone, sound output from a driver of the headphone, wherein the driver outputs the sound based on a third sound signal, and wherein the third sound signal is obtained by a signal processing on the first sound signal; and selecting a first parameter for a first filter configured to adjust sound quality of the first sound signal and a second parameter for a second filter configured to execute noise reduction processing of the second sound signal, wherein the first parameter and the second parameter are selected based on the calculated difference, wherein the first filter is different from the second filter, and wherein the difference between the reproduction target characteristics of the first sound signal and the characteristics of the second sound signal is based on a difference in physical characteristics of wearers of the headphone.

12. A non-transitory computer-readable storage medium having stored thereon, computer-executable instructions, which when executed by a computer, cause the computer to execute operations, the operations comprising:

calculating a difference between reproduction target characteristics of a first sound signal and characteristics of a second sound signal, wherein the second sound signal is obtained by collecting, by a microphone inside a headphone, sound output from a driver of the headphone, wherein the driver outputs the sound based on a third sound signal, and wherein the third sound signal is obtained by a signal processing on the first sound signal; and selecting a first parameter for a first filter configured to adjust sound quality of the first sound signal and a second parameter for a second filter configured to execute noise reduction processing of the second sound signal, wherein the first parameter and the second parameter are selected based on the calculated difference, wherein the first filter is different from the second filter, and wherein the difference between the reproduction target characteristics of the first sound signal and the characteristics of the second sound signal is based on a difference in physical characteristics of wearers of the headphone.

13. The signal processing apparatus according to claim 1, wherein the physical characteristics include at least one of a shape of head, a size of ear or a length of hair of each of the wearers.

14. The signal processing apparatus according to claim 13, wherein the difference between the reproduction target characteristics of the first sound signal and the characteristics of the second sound signal is further based on a volume of air inside the headphone, and wherein the volume of air varies based on the physical characteristics of the wearers.

* * * * *